US011536291B2

(12) United States Patent
Kono et al.

(10) Patent No.: US 11,536,291 B2
(45) Date of Patent: Dec. 27, 2022

(54) ROTOR HANGING TOOL, ROTOR SUPPORT JIG, ROTOR LIFTING METHOD, AND ROTARY MACHINE DISASSEMBLY METHOD

(71) Applicants: MITSUBISHI HEAVY INDUSTRIES COMPRESSOR CORPORATION, Tokyo (JP); Mitsubishi Heavy Industries Compressor International Corporation, Houston, TX (US)

(72) Inventors: Yoshikuni Kono, Hiroshima (JP); Akinori Tasaki, Houston, TX (US)

(73) Assignees: MITSUBISHI HEAVY INDUSTRIES COMPRESSOR CORPORATION, Tokyo (JP); Mitsubishi Heavy Industries Compressor International Corporation, Houston, TX (US)

( * ) Notice: Subject to any disclaimer, the term of this patent is extended or adjusted under 35 U.S.C. 154(b) by 431 days.

(21) Appl. No.: 16/781,308

(22) Filed: Feb. 4, 2020

(65) Prior Publication Data

US 2021/0239133 A1 Aug. 5, 2021

(51) Int. Cl.

| | |
|---|---|
| ***F04D 29/60*** | (2006.01) |
| ***F01D 25/28*** | (2006.01) |
| ***F01D 25/26*** | (2006.01) |
| ***F04D 29/12*** | (2006.01) |

(52) U.S. Cl.

CPC ..... *F04D 29/60* (2013.01); *F01D 25/265* (2013.01); *F01D 25/285* (2013.01); *F04D 29/12* (2013.01); *F05D 2230/64* (2013.01)

(58) Field of Classification Search

CPC ..... F04D 29/60; F04D 17/122; F04D 29/102; F04D 29/4206; F04D 29/624; F01D 25/285; F01D 25/265; F05D 2230/64; F05D 2230/68; F05D 2230/70; B66C 13/08

See application file for complete search history.

(56) References Cited

U.S. PATENT DOCUMENTS

| | | | | |
|---|---|---|---|---|
| 6,203,270 | B1 * | 3/2001 | Magoshi | F01D 25/285 415/126 |
| 8,777,565 | B2 * | 7/2014 | Kondo | F01D 25/265 415/214.1 |
| 10,550,727 | B2 * | 2/2020 | Waki | F02C 7/06 |
| 11,174,758 | B2 * | 11/2021 | Iwai | F01D 25/28 |

(Continued)

FOREIGN PATENT DOCUMENTS

JP 2019-044721 A 3/2019

*Primary Examiner* — Lawrence Averick

(74) *Attorney, Agent, or Firm* — Osha Bergman Watanabe & Burton LLP

(57) ABSTRACT

A rotor hanging tool includes a beam extending in parallel to an axial direction above a rotor main body, a pair of ring support portions disposed at an interval in the axial direction, connected to the beam, and attachable to and detachable from a support ring, a pair of rotor support portions disposed at an interval in the axial direction, connected to the beam, attachable to and detachable from the rotor main body at positions different from the ring support portions in the axial direction, and respectively supporting the rotor main body from below, and a vertical position adjustment unit for adjusting a position of each of the rotor support portions in a vertical direction with respect to the beam.

5 Claims, 21 Drawing Sheets

(56) References Cited

U.S. PATENT DOCUMENTS

| | | | | |
|---|---|---|---|---|
| 2011/0020117 | A1* | 1/2011 | Kondo | F01D 25/265<br>415/182.1 |
| 2017/0138218 | A1* | 5/2017 | Waki | F01D 25/16 |
| 2019/0072108 | A1 | 3/2019 | Yamada et al. | |
| 2021/0180469 | A1* | 6/2021 | Iwai | F01D 25/28 |
| 2022/0235675 | A1* | 7/2022 | Pilichowska | F01D 5/005 |

* cited by examiner

ROTOR HANGING TOOL, ROTOR SUPPORT JIG, ROTOR LIFTING METHOD, AND ROTARY MACHINE DISASSEMBLY METHOD

TECHNICAL FIELD

The present disclosure relates to a rotor hanging tool, a rotor support jig, a rotor lifting method, and a rotary machine disassembly method.

BACKGROUND ART

A rotary machine such as a centrifugal compressor and a steam turbine is provided with a rotor rotating about an axis and a casing covering the rotor. The rotor has a rotor main body extending in the axial direction that is about the axis and a plurality of impellers disposed on a rotor shaft. As disclosed in Patent Document 1, such rotary machines include those having a structure in which the casing can be divided into one upper half portion and one lower half portion. The upper half portion of the casing is removed from the lower half portion and the upper half of the rotor in the casing is exposed during rotor maintenance or replacement. Subsequently, the rotor is lifted and taken out of the lower half portion and the rotor is maintained or replaced.

In a case where the rotor is lifted and taken out of the lower half portion of the casing, a rotor support jig is used at a plurality of axially spaced locations. The rotor is taken out of the lower half portion of the casing by the jig being lifted with the jig supporting the rotor.

CITATION LIST

Patent Literature

[Patent Document 1] Japanese Unexamined Patent Application, First Publication No. 2019-44721

SUMMARY OF INVENTION

Technical Problem

By the way, the rotor is provided with members such as an annular seal member for ensuring sealability in the gap between the casing and the rotor and a support ring (seal housing holder) fixing the seal member to a casing. The seal member and the support ring are disposed so as to protrude radially outward with respect to the rotor main body. In a case where the seal member is a labyrinth seal, the distance between the seal member and the outer peripheral surface of the rotor main body in the radial direction is very small so that sealability is ensured. Accordingly, when the rotor is lifted, it is necessary to prevent the seal member from being damaged by coming into contact with the rotor main body during the lifting work. Therefore, it is necessary to remove the seal member in advance.

In addition, in a case where the seal member is a dry gas seal, the seal member is a precision component and is damaged when an external force is applied. In this regard, when the rotor is lifted, it is necessary to prevent the seal member from being subjected to the own weight of the support ring or being damaged due to misalignment with the rotor during the lifting work. Accordingly, it is necessary to remove the seal member in advance in order to suppress damage to the seal member.

However, the rotor main body has an end portion provided with a coupling interconnecting the rotor main body and another rotary machine such as a motor and a driven machine. Further, in some cases, a thrust disk for causing a thrust bearing to support a thrust force is disposed between the seal member and the end portion of the rotor main body. The coupling and the thrust disk are formed so as to protrude radially outward with respect to the rotor main body. Accordingly, it is necessary to first remove the coupling and the thrust disk from the rotor main body in order to remove the seal member from the rotor main body.

As a result, work such as rotor removal and replacement takes time and effort and leads to a decline in maintenance work efficiency. In addition, the operation of the rotary machine needs to be stopped during the maintenance work and this necessity leads to a decline in rotary machine operating rate.

An object of the present disclosure is to provide a rotor hanging tool, a rotor support jig, a rotor lifting method, and a rotary machine disassembly method allowing rotor removal efficiency enhancement.

Solution to Problem

In order to solve the above problems, a rotor hanging tool according to an aspect of the present disclosure is a rotor hanging tool for hanging a rotor provided with a rotor main body extending in an axial direction, a pair of annular support rings respectively disposed at a first end and a second end of the rotor main body at an interval in the axial direction and provided outside the rotor main body in a radial direction, and a pair of seal members disposed on an inner peripheral surface of the support ring in a state where a space is open between the seal member and an outer peripheral surface of the rotor main body and the rotor hanging tool includes a beam extending in parallel to the axial direction above the rotor main body, a pair of ring support portions disposed at an interval in the axial direction, connected to the beam, and attachable to and detachable from the support ring, a pair of rotor support portions disposed at an interval in the axial direction, connected to the beam, attachable to and detachable from the rotor main body at positions different from the ring support portions in the axial direction, and respectively supporting the rotor main body from below, and an vertical position adjustment unit configured to adjust a position of each of the rotor support portions in a vertical direction with respect to the beam.

Advantageous Effects of Invention

Rotor removal efficiency can be enhanced according to the rotor hanging tool, the rotor support jig, the rotor lifting method, and the rotary machine disassembly method of the present disclosure.

DESCRIPTION OF EMBODIMENTS

Hereinafter, an embodiment of a rotor hanging tool, a rotor support jig, a rotor support base, a rotor lifting method, a method for removing a rotor from a rotary machine (rotary machine disassembly method), and a method for attaching a rotor to a rotary machine according to the present disclosure will be described with reference to the accompanying drawings. However, the present disclosure is not limited to this embodiment.

Hereinafter, the rotor hanging tool, the rotor support jig, the rotor lifting method, and the rotary machine disassembly method according to the embodiment of the present disclosure will be described with reference to FIGS. 1 to 21.

(Configuration of Rotary Machine)

Figure 1:
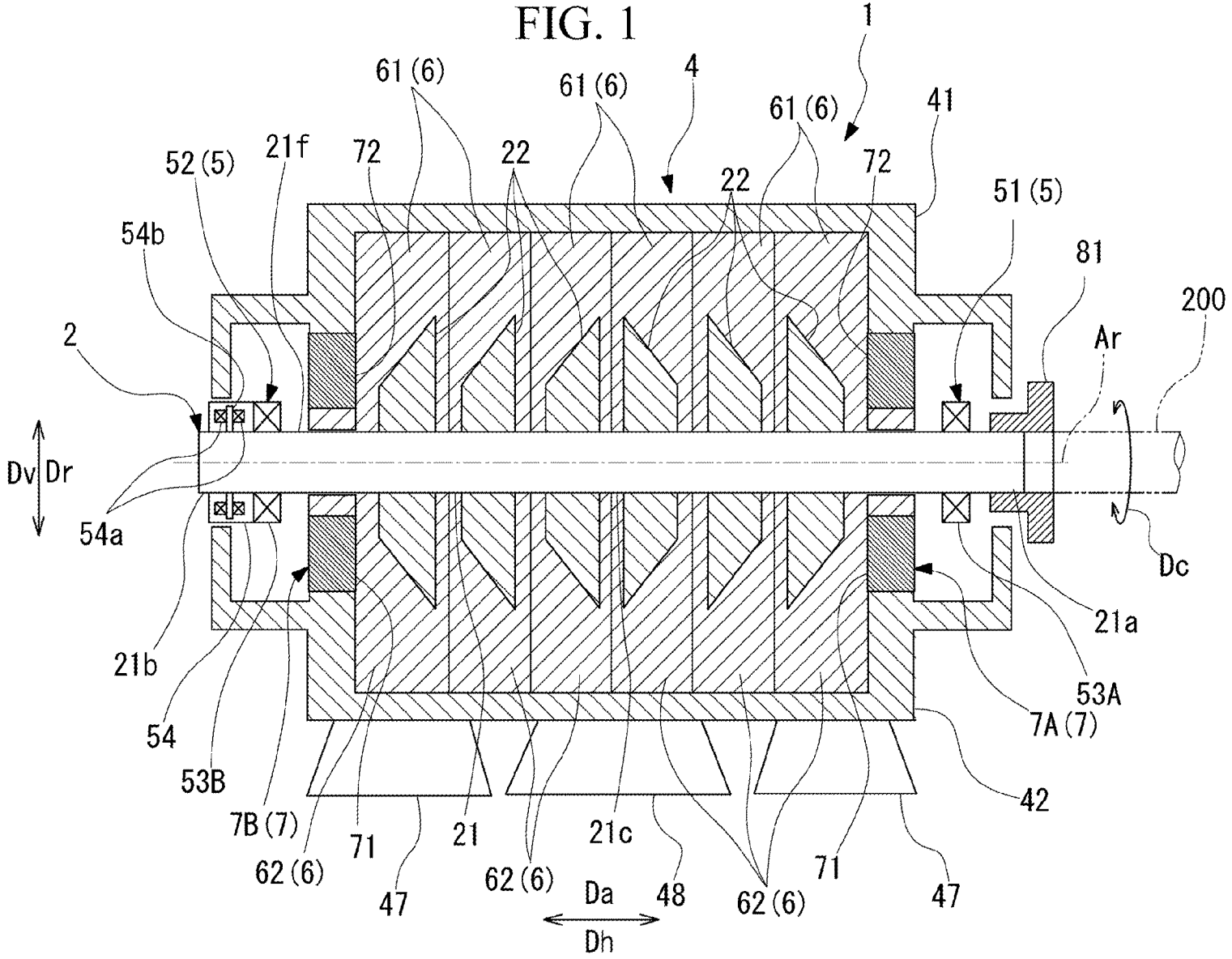
FIG. 1 is a cross-sectional view showing a schematic configuration of a rotary machine according to an embodiment of the present disclosure.

First, a rotary machine for performing the rotary machine disassembly method, the rotor lifting method, the rotor support jig, and the rotor hanging tool according to the embodiment of the present disclosure will be described. As shown in FIG. 1, a rotary machine 1 mainly includes a rotor 2, a casing 4, a bearing portion 5, and seal portions 7. In the embodiment of the present disclosure, the rotary machine 1 is, for example, a multistage centrifugal compressor.

(Configuration of Rotor)

The rotor 2 is rotatable about an axis Ar in the casing 4. The rotor 2 is provided with a rotor main body 21 and an impeller 22. The rotor main body 21 extends in an axial direction Da about the axis Ar. The rotor main body 21 is supported by the bearing portion 5 so as to be rotatable around the axis Ar.

It should be noted that the direction in which the axis Ar extends is the axial direction Da in the following description. A vertical direction Dv is the vertical direction that is orthogonal to the axial direction Da. In other words, a plane orthogonal to the vertical direction Dv is a horizontal plane. The axial direction Da of the rotor main body 21 is along the horizontal plane. The radial direction that is based on the axis Ar will be simply referred to as a radial direction Dr. A width direction Dw is the radial direction Dr that is orthogonal to the vertical direction Dv. In addition, a circumferential direction Dc is around the rotor 2 about the axis Ar.

A plurality of the impellers 22 are disposed at intervals in the axial direction Da. Each impeller 22 is fixed to the rotor main body 21. Each impeller 22 is rotatable around the axis Ar integrally with the rotor main body 21. A total of, for example, six impellers 22 are provided in the embodiment of the present disclosure. The impellers 22 are symmetrically provided on the side that is close to a first end 21*a* of the rotor main body 21 (first end 21*a* side) and the side that is close to a second end 21*b* of the rotor main body 21 (second end 21*b* side) with respect to a middle portion 21*c* of the rotor main body 21 in the axial direction Da. The three impellers 22 that are on the first end 21*a* side and the three impellers 22 that are on the second end 21*b* side are disposed in a back-to-back manner with respect to the middle portion 21*c* of the rotor main body 21.

A coupling member 81 is mounted at the first end 21*a* of the rotor main body 21 in the embodiment of the present disclosure. Detachably connected to the coupling member 81 is an external shaft 200, which is provided outside the casing 4 and driven to rotate around the axis Ar by another rotary machine (not shown).

It should be noted that the number of the impellers 22 provided on the rotor main body 21 and the orientation of the impellers 22 are not limited to the above examples and can be changed as appropriate.

(Configuration of Casing)

The casing 4 has a tubular shape extending in the axial direction Da about the axis Ar. Formed in the casing 4 are a suction port 47 for guiding a working fluid into the casing 4 and a discharge port 48 for discharging the working fluid from the inside of the casing 4 to the outside. The casing 4 accommodates the rotor 2 together with a diaphragm 6. The casing 4 has an upper half casing 41 above the axis Ar of the rotor 2 and a lower half casing 42 below the axis Ar of the rotor 2.

The upper half casing 41 extends in the circumferential direction Dc. The cross section of the upper half casing 41 that is orthogonal to the axis Ar has a semi-annular shape about the axis Ar. The upper half casing 41 is open downward in the vertical direction Dv such that the rotor 2 and an upper half diaphragm 61 can be accommodated. The upper half casing 41 has division surfaces (upper half casing division surfaces) at both ends in the circumferential direction Dc. The division surfaces of the upper half casing 41 are horizontal surfaces directed downward in the vertical direction Dv.

The lower half casing 42 extends in the circumferential direction Dc. The cross section of the lower half casing 42 that is orthogonal to the axis Ar has a semi-annular shape about the axis Ar. The inner diameter of the lower half casing 42 is formed so as to be equal in size to the inner diameter of the upper half casing 41. The lower half casing 42 is open upward in the vertical direction Dv such that the rotor 2 and a lower half diaphragm 62 can be accommodated. The lower half casing 42 has division surfaces (lower half casing division surfaces) at both ends in the circumferential direction Dc. The division surfaces of the lower half casing 42 are horizontal surfaces directed upward in the vertical direction Dv. The upper half casing 41 is placed above the lower half casing 42 in the vertical direction Dv. The upper half casing 41 and the lower half casing 42 are fixed by means of a fastening member such as a bolt (not shown) in a state where the division surfaces are in contact with each other. The casing 4 is formed as a result.

(Configuration of Diaphragm)

The diaphragm 6 is provided outside the rotor main body 21 in the radial direction Dr. A plurality of the diaphragms 6 are disposed side by side in the axial direction Da so as to correspond respectively to the impellers 22. The diaphragm 6 has an annular shape about the axis Ar. The annular diaphragm 6 has the upper half diaphragm 61 above the axis Ar of the rotor 2 in the vertical direction Dv and the lower half diaphragm 62 below the axis Ar of the rotor 2 in the vertical direction Dv. The upper half diaphragm 61 is fixed to the upper half casing 41 in a state where the upper half diaphragm 61 is accommodated inside the upper half casing 41. The lower half diaphragm 62 is fixed to the lower half casing 42 in a state where the lower half diaphragm 62 is accommodated inside the lower half casing 42.

(Configuration of Bearing Portion)

The bearing portion 5 rotatably supports the rotor main body 21 about the axis Ar. The bearing portion 5 is disposed in the casing 4. The bearing portion 5 has a first bearing portion 51 and a second bearing portion 52.

The first bearing portion 51 supports the rotor main body 21 on the first end 21*a* side in the axial direction Da with respect to the plurality of impellers 22. The first bearing portion 51 has a structure that can be divided in the vertical direction Dv. The first bearing portion 51 has a journal bearing 53A. The journal bearing 53A receives a load in the radial direction Dr acting on the rotor main body 21.

The second bearing portion 52 supports the rotor main body 21 on the second end 21*b* side in the axial direction Da with respect to the plurality of impellers 22. The second bearing portion 52 has a structure that can be divided in the vertical direction Dv. The second bearing portion 52 has a journal bearing 53B and a thrust bearing 54. The journal bearing 53B receives a load in the radial direction Dr acting on the rotor main body 21.

The thrust bearing 54 receives a load in the axial direction Da acting on the rotor main body 21 via a thrust disk 54*b* (described later). The thrust bearing 54 is disposed on the second end 21*b* side in the axial direction Da (side away from the middle portion 21*c* of the rotor main body 21) with respect to the journal bearing 53B.

On the rotor main body 21, the thrust disk 54*b* is disposed at the position that corresponds to the position of the thrust bearing 54 in the axial direction Da. The thrust disk 54*b* protrudes to the outside in the radial direction Dr from the rotor main body 21. Specifically, the thrust disk 54*b* has an annular shape. The thrust disk 54*b* is detachably provided with respect to an outer peripheral surface 21*f* of the rotor main body 21.

The thrust bearing 54 is provided with bearing pads 54*a* disposed on both sides in the axial direction Da with respect to the thrust disk 54*b*. The thrust bearing 54 restrains a movement of the thrust disk 54*b* in the axial direction Da by means of the bearing pad 54*a*.

(Configuration of Seal Portion)

The seal portion 7 seals the gap between the rotor 2 and the casing 4. The seal portion 7 suppresses working fluid outflow to the outside of the casing 4 from the gap between the rotor 2 and the casing 4 and foreign matter intrusion or the like from the outside into the casing 4. The seal portions 7 are disposed at an interval in the axial direction Da so as to sandwich the plurality of impellers 22. The seal portion 7 is provided with a first seal portion 7A on the first end 21*a* side and a second seal portion 7B on the second end 21*b* side. The first seal portion 7A is disposed at a position close to the middle portion 21*c* of the rotor main body 21 in the axial direction Da with respect to the first bearing portion 51. The second seal portion 7B is disposed at a position close to the middle portion 21*c* of the rotor main body 21 in the axial direction Da with respect to the first bearing portion 51.

The first seal portion 7A and the second seal portion 7B are provided with a support ring 71 and a seal member 72, respectively. In other words, the rotary machine 1 is provided with a pair of support rings 71 and a pair of seal members 72.

The support ring 71 extends in the circumferential direction Dc. A through-hole is formed in the middle portion of the support ring 71 and the through-hole has a circular shape when viewed from the axial direction Da. In other words, the support ring 71 has an annular shape. The outer peripheral surface of the support ring 71 is in contact with the inner peripheral surface of the upper half casing 41 and the inner peripheral surface of the lower half casing 42.

The seal member 72 is disposed inside the support ring 71 in the radial direction Dr. The seal member 72 is detachably fixed to the inner peripheral surface of the through-hole of the support ring 71. The seal member 72 is provided between the inner peripheral surface of the support ring 71 and the outer peripheral surface of the rotor main body 21. The seal member 72 is fixed to the support ring 71 in a state where a space is open between the seal member 72 and the outer peripheral surface of the rotor main body 21.

The seal member 72 is, for example, a dry gas seal in the embodiment of the present disclosure. The dry gas seal is provided with a rotary ring (not shown) and a stationary ring (not shown). The rotary ring is provided integrally with the rotor main body 21 at the outer peripheral part of the rotor main body 21. The stationary ring is fixed to the inner peripheral surface of the support ring 71. The stationary ring is provided so as to face the rotary ring in the axial direction Da of the rotor main body 21. The stationary ring is pressed toward the rotary ring by a coil spring or the like. As a result, the stationary ring and the rotary ring abut against each other in a state where the rotary machine is stationary. When the rotary machine 1 operates and the rotor main body 21 rotates, seal gas is introduced between the rotary ring and the stationary ring. Due to the pressure of the seal gas, the stationary ring is pressed along the axial direction Da against the biasing force of the coil spring. As a result, a minute gap is formed between the rotary ring and the stationary ring, and thus the working fluid in the casing 4 is prevented from leaking out of the casing 4.

It should be noted that the seal member 72 may further include a labyrinth seal.

(Configuration of Rotor Support Jig)

Figure 2:
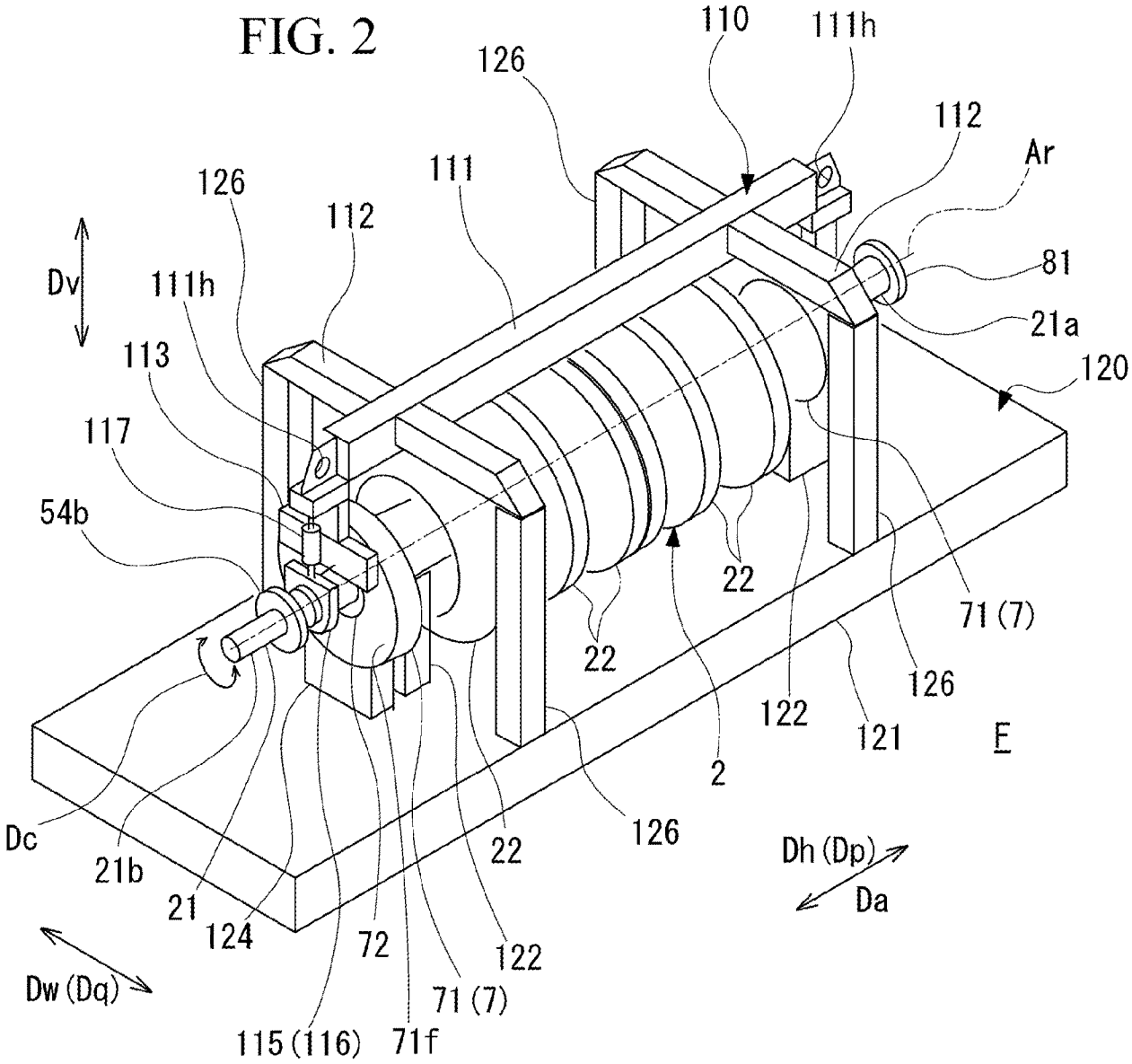
FIG. 2 is a perspective view showing a rotor support jig according to the embodiment of the present disclosure.
Figure 3:
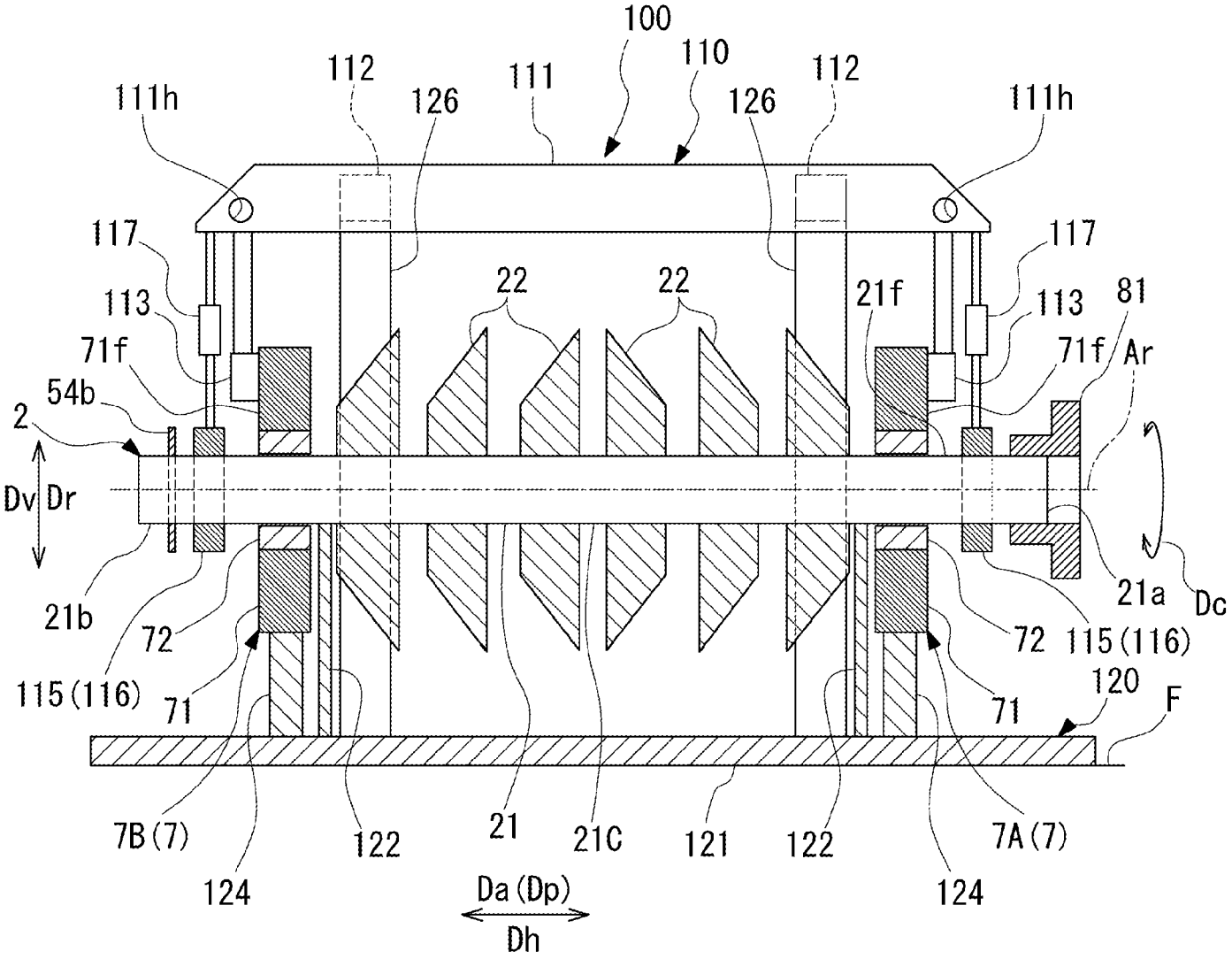
FIG. 3 is a cross-sectional view showing the configuration of the rotor support jig.

A rotor support jig 100 described below is used for the rotor 2 to be removed from and attached to the rotary machine 1. As shown in FIGS. 2 and 3, the rotor support jig 100 is provided with a rotor hanging tool 110 and a rotor support base 120.

(Configuration of Rotor Hanging Tool)

The rotor hanging tool 110 can be held in a state where the rotor 2 is hung. The rotor hanging tool 110 is provided with a beam 111, an arm 112, a ring support portion 113, a rotor support portion 115, and a vertical position adjustment unit 117.

The beam 111 linearly extends along a horizontal direction Dh. The beam 111 is disposed so as to extend in the axial direction Da so as to be parallel to the rotor main body 21 above the rotor main body 21 in the vertical direction Dv when the rotor hanging tool 110 is used. Attachment holes 111*h* are respectively formed in both end portions of the beam 111 in the axial direction Da. A wire or a hook of a lifting machine such as a crane can be attached to each attachment hole 111*h*. The beam 111 can be moved in the vertical direction Dv by the lifting machine with the wire or the hook attached to each attachment hole 111*h*.

The arm 112 is disposed at a plurality of locations in the beam 111 at intervals in the axial direction Da. In the embodiment of the present disclosure, a pair of arms 112 are connected to both end portions of the beam 111 in the axial direction Da. The arms 112 extend from the beam 111 to both sides in the width direction Dw orthogonal to the axial direction Da. The arm 112 is provided integrally with the beam 111.

The ring support portion 113 is capable of supporting the support ring 71. A pair of the ring support portions 113 are disposed in the beam 111 at an interval in the axial direction Da. Each ring support portion 113 extends downward in the vertical direction Dv from the beam 111. The ring support portion 113 is connected to the beam 111 at a position closer to the end portion of the beam 111 than the arm 112 in the axial direction Da. The position of the ring support portion 113 in the axial direction Da faces the side surface of the support ring 71. Specifically, the ring support portion 113 is disposed at a position along a ring surface 71*f* of the support ring 71 facing the outer side in the axial direction Da (end portion of the rotor main body 21). The ring support portion 113 can be detachably fixed to the ring surface 71*f* of the support ring 71 by a fixing member (not shown) such as a bolt. In other words, the ring support portion 113 is attachable to and detachable from the ring surface 71*f*.

The rotor support portion 115 is capable of supporting the rotor main body 21. A pair of the rotor support portions 115 are disposed in the beam 111 at an interval in the axial direction Da. Each rotor support portion 115 is connected to the beam 111 via the vertical position adjustment unit 117. Each rotor support portion 115 is disposed at a position different from the ring support portion 113 in the axial direction Da. In the embodiment of the present disclosure, the rotor support portion 115 is disposed between the thrust disk 54*b* and the seal portion 7 in the axial direction Da in a state where the rotor hanging tool 110 hangs the rotor 2. The rotor support portion 115 is disposed at a position close to the end portion of the beam 111 with respect to the rotor support portion 115. The rotor support portion 115 is capable of supporting the rotor main body 21 from below in the vertical direction Dv. The rotor support portion 115 is provided with a support portion main body 116 extending in the circumferential direction Dc. The support portion main body 116 is annular when viewed from the axial direction Da and can be divided into one upper part and one lower part. The support portion main body 116 is attachable to and detachable from the rotor main body 21 in a state where the rotor main body 21 is inserted through the support portion main body 116.

The vertical position adjustment unit 117 is capable of adjusting the position of the rotor support portion 115 in the vertical direction Dv with respect to the beam 111. The vertical position adjustment unit 117 extends downward in the vertical direction Dv from the beam 111. The vertical position adjustment unit 117 interconnects the beam 111 and the rotor support portion 115. The vertical position adjustment unit 117 is, for example, a turnbuckle in the embodiment of the present disclosure.

(Configuration of Rotor Support Base)

The rotor support base 120 is capable of supporting the rotor 2 and the rotor hanging tool 110 supporting the rotor 2. The rotor support base 120 is provided with a base 121, a first support portion 122, a second support portion 124, and a third support portion 126.

The base 121 has a rectangular shape when viewed from the vertical direction Dv. The base 121 is placed on an installation surface F. The base 121 is disposed in a state where a longitudinal direction Dp of the base 121 is along the axial direction Da of the rotor 2. It is preferable that the base 121 is large enough to be mounted on a transport vehicle such as a truck and a trailer.

The first support portion 122 supports the rotor main body 21 from below. A pair of the first support portions 122 are disposed on the base 121. The pair of first support portions 122 are disposed at an interval in the longitudinal direction Dp of the base 121 (axial direction Da). Each first support portion 122 is disposed in the middle portion of the base 121 in a short direction Dq (width direction Dw). Each first support portion 122 extends upward in the vertical direction Dv from the upper surface of the base 121. A rotor support surface on which the rotor main body 21 can be placed is formed on the upper surface of each first support portion 122. The rotor support surface is formed in a circular arc shape that is recessed downward so as to be along the outer peripheral surface 21*f* of the rotor main body 21. The height of each first support portion 122 is adjustable in the vertical direction Dv.

The second support portion 124 supports the support ring 71 from below. A pair of the second support portions 124 are disposed on the base 121. The pair of second support portions 124 are disposed at an interval in the longitudinal direction Dp of the base 121 (axial direction Da). Each second support portion 124 is disposed in the middle portion of the base 121 in the short direction Dq (width direction Dw). Each second support portion 124 extends upward in the vertical direction Dv from the upper surface of the base 121. A ring support surface on which the support ring 71 can be placed is formed on the upper surface of each second support portion 124. The ring support surface is formed in a circular arc shape that is recessed downward so as to be along the outer peripheral surface of the support ring 71. The height of each second support portion 124 is adjustable in the vertical direction Dv.

The first support portion 122 and the second support portion 124 support the rotor 2 from below. Specifically, the rotor main body 21 is supported by the pair of first support portions 122 in two places separated in the axial direction Da. Further, the pair of support rings 71 are supported by the pair of second support portions 124. In this manner, the rotor 2 is held by the first support portion 122 and the second support portion 124 in a state where the relative positions of the rotor main body 21 and the support ring 71 in the radial direction Dr are fixed.

The second support portion 124 is disposed at a position closer to the outer peripheral edge of the base 121 than the first support portion 122 in the longitudinal direction Dp of the base 121 (axial direction Da). In other words, the first support portion 122 is disposed at a position close to the middle portion 21*c* of the rotor main body 21 in the axial direction Da with respect to the second support portion 124. In other words, the first support portion 122 supports the rotor main body 21 at a position closer to the middle portion 21*c* of the rotor main body 21 than the support ring 71.

The third support portion 126 supports the arm 112 from below. Two sets of the third support portions 126 are disposed on the base 121. The two sets of third support portions 126 are disposed at an interval in the longitudinal direction Dp of the base 121 (axial direction Da). The third support portions 126 of each set are disposed at an interval capable of accommodating the rotor 2 in the short direction Dq of the base 121 (width direction Dw). In other words, the third support portion 126 is disposed at a position separated from the rotor 2 in the width direction Dw when viewed from the vertical direction Dv. Each third support portion 126 extends upward in the vertical direction Dv from the upper surface of the base 121. The distal end portion of the arm 112 can be placed on each third support portion 126. The distal end portion of the arm 112 and the upper end of the third support portion 126 are detachably interconnected by a fixing member (not shown) such as a bolt. The rotor hanging tool 110 is supported from below by the third support portions 126 in a state where the rotor 2 is hung.

(Procedures of Rotor Lifting Method and Rotary Machine Disassembly Method)

Next, the method for lifting the rotor 2 from the rotary machine 1 will be described. It should be noted that the method for lifting the rotor 2 is a part of the rotary machine disassembly method and is included in a part of the method for removing the rotor 2 from the rotary machine 1.

Figure 4:
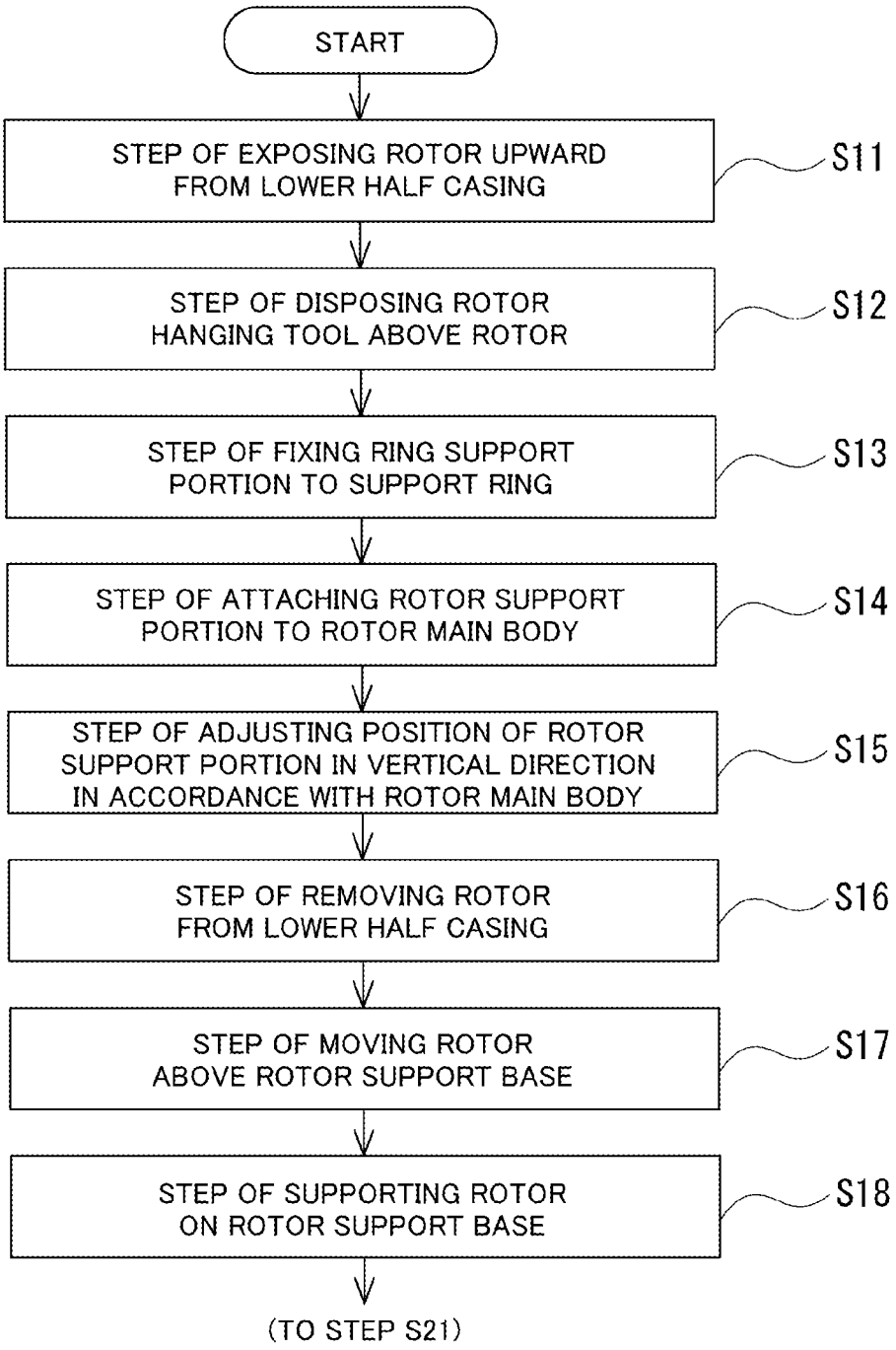
FIG. 4 is a first flowchart showing the procedures of a rotor lifting method and a rotary machine disassembly method according to the embodiment of the present disclosure.

As shown in FIG. 4, the rotary machine disassembly method includes a step S11 of exposing the rotor 2 upward from the lower half casing 42, a step S12 of disposing the rotor hanging tool 110 above the rotor 2, a step S13 of fixing the ring support portion 113 to the support ring 71, a step S14 of attaching the rotor support portion 115 to the rotor main body 21, a step S15 of adjusting the position of the rotor support portion 115 in the vertical direction Dv in accordance with the rotor main body 21, a step S16 of removing the rotor 2 from the lower half casing 42, a step S17 of moving the rotor 2 above the rotor support base 120, and a step S18 of supporting the rotor 2 on the rotor support base 120.

It should be noted that the step S12 of disposing the rotor hanging tool 110 above the rotor 2, the step S13 of fixing the ring support portion 113 to the support ring 71, the step S14 of supporting the rotor main body 21 with the rotor support portion 115, and the step S15 of adjusting the position of the rotor support portion 115 in the vertical direction Dv in accordance with the rotor main body 21 are the rotor lifting method according to the embodiment of the present disclosure.

Figure 5:
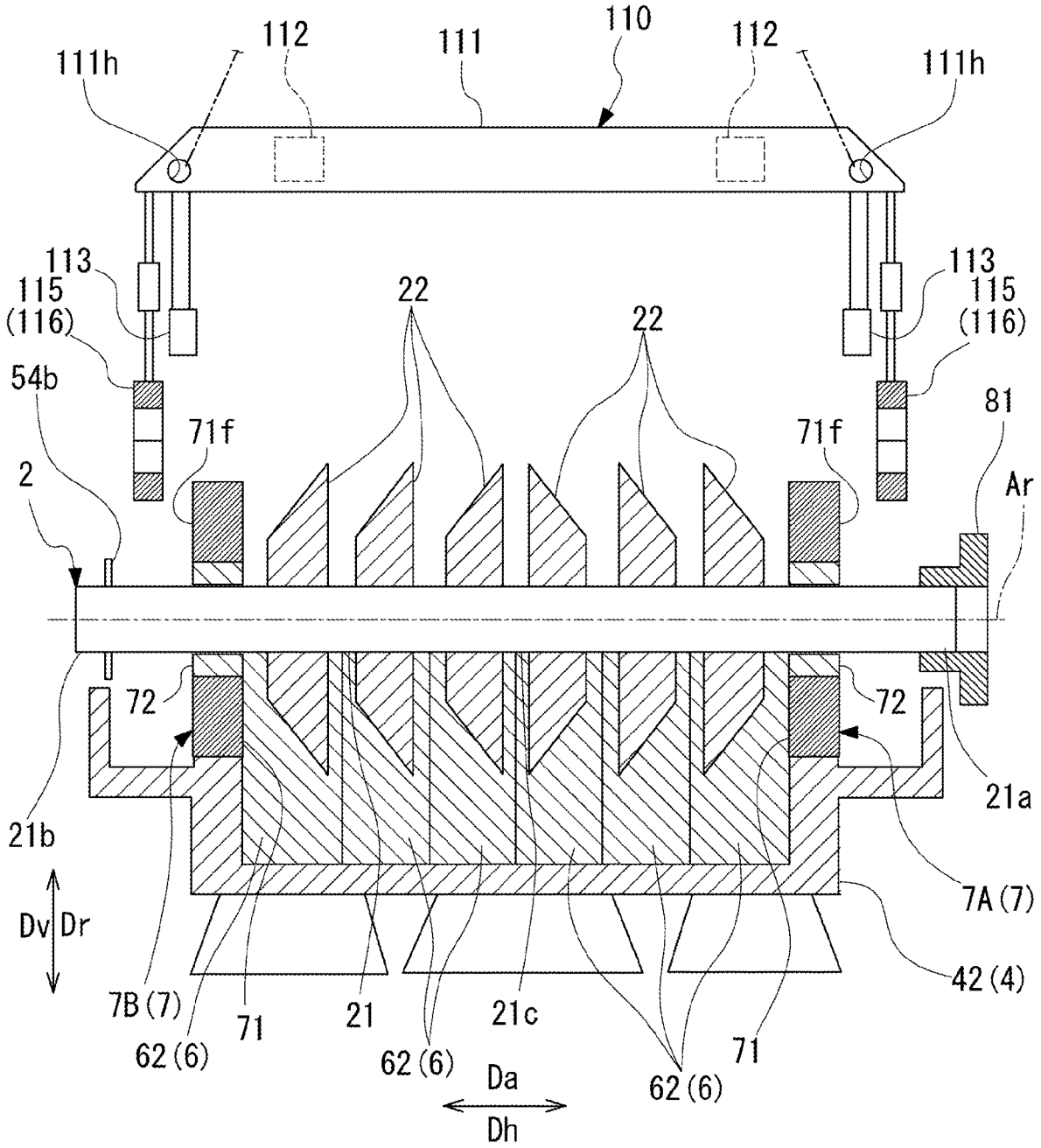
FIG. 5 is a diagram showing a step of exposing a rotor upward from a lower half casing and a step of disposing a rotor hanging tool above the rotor.

As shown in FIG. 5, in the step S11 of exposing the rotor 2 upward from the lower half casing 42, the upper half casing 41 of the casing 4 of the rotary machine 1 is removed from the lower half casing 42 after the rotor hanging tool 110 is prepared. The upper half diaphragm 61 is removed together with the upper half casing 41. As a result, the rotor 2 is exposed upward from the lower half casing 42. In addition, in the step S11 of exposing the rotor 2 upward from the lower half casing 42, the first bearing portion 51 and the second bearing portion 52 are divided in the vertical direction Dv and removed from the rotor main body 21. The thrust disk 54*b* remains on the rotor main body 21 when the thrust bearing 54 is removed in the second bearing portion 52.

In the step S12 of disposing the rotor hanging tool 110 above the rotor 2, a wire or a hook of a lifting machine such as a crane is first attached to the attachment hole 111*h* of the beam 111. Next, the beam 111 is lifted by the lifting machine and the rotor hanging tool 110 is disposed above the rotor 2. The rotor hanging tool 110 is disposed above the rotor 2 such that the direction in which the beam 111 extends is parallel to the axial direction Da of the rotor 2.

Figure 6:
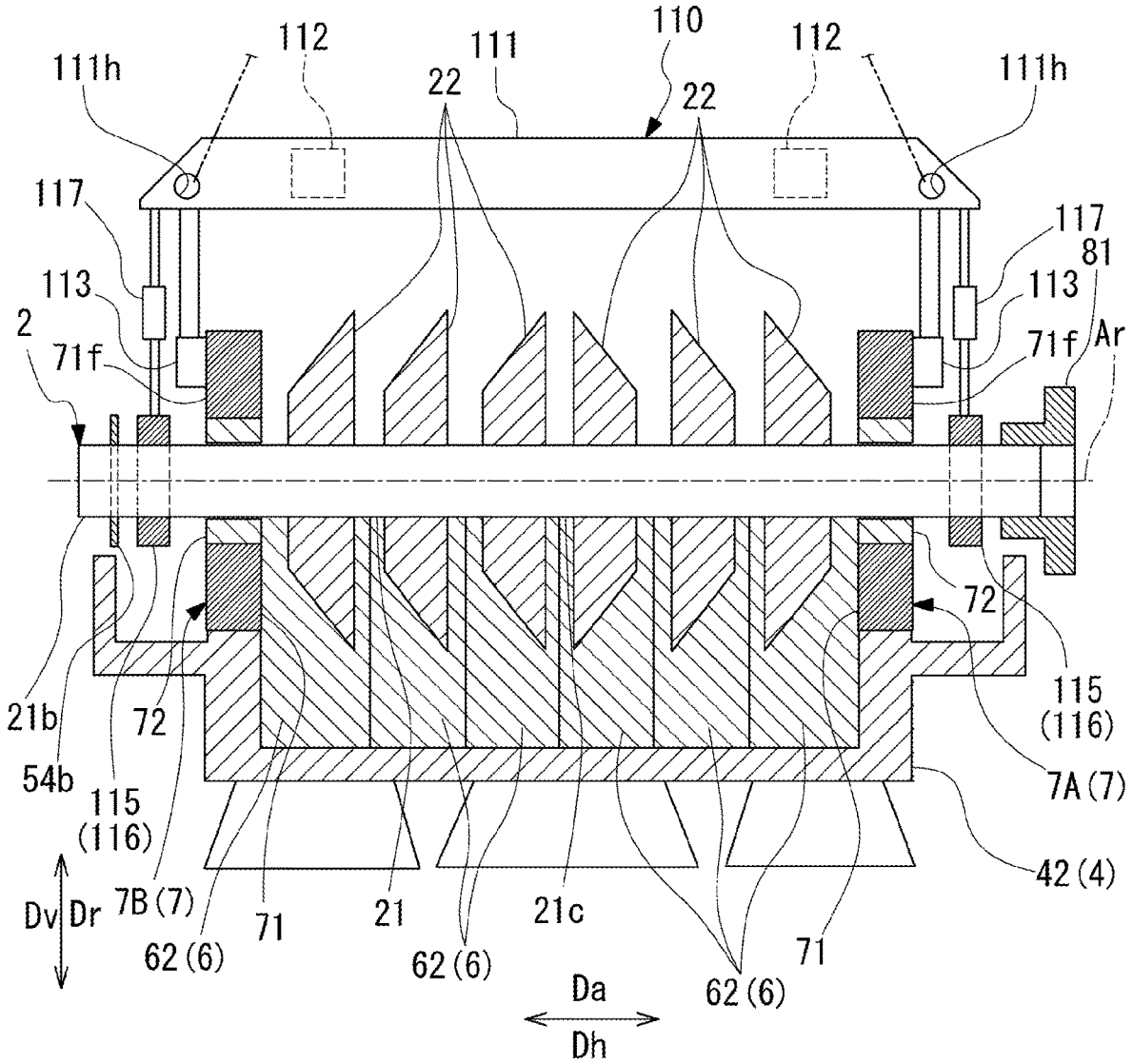
FIG. 6 is a diagram showing a step of fixing a ring support portion to a support ring and a step of supporting a rotor main body with a rotor support portion.

In the step S13 of fixing the ring support portion 113 to the support ring 71, the lifted beam 111 is first lowered by the lifting machine as shown in FIG. 6. As a result, the rotor hanging tool 110 is disposed such that the pair of ring support portions 113 are along the ring surface 71*f* with respect to the support ring 71. Next, each ring support portion 113 is fixed to the ring surface 71*f* by a bolt (not shown).

In the step S14 of attaching the rotor support portion 115 to the rotor main body 21, the rotor main body 21 is sandwiched so as to be surrounded by the support portion main body 116. As a result, the pair of rotor support portions 115 are attached to the rotor main body 21.

In the step S15 of adjusting the position of the rotor support portion 115 in the vertical direction Dv in accordance with the rotor main body 21, the vertical position adjustment unit 117 adjusts the positions of a pair of the support portion main bodies 116 in the vertical direction Dv in accordance with the rotor main body 21. To this end, the support portion main body 116 is moved in the vertical direction Dv by a turnbuckle that is the vertical position adjustment unit 117. As a result, the position of the support portion main body 116 in the vertical direction is adjusted such that the position of the center line (axis) of the rotor main body 21 supported by the rotor support portion 115 in the vertical direction Dv is aligned with the position of the center line of the seal member 72 in the vertical direction Dv. As a result, the rotor 2 is supported in a state where the rotor 2 is incapable of moving relative to the rotor hanging tool 110 with the position of the center line of the rotor main body 21 and the position of the center line of the seal member 72 aligned. As a result, the rotor main body 21 is supported from below by the pair of rotor support portions 115 in a core-aligned state.

Figure 7:
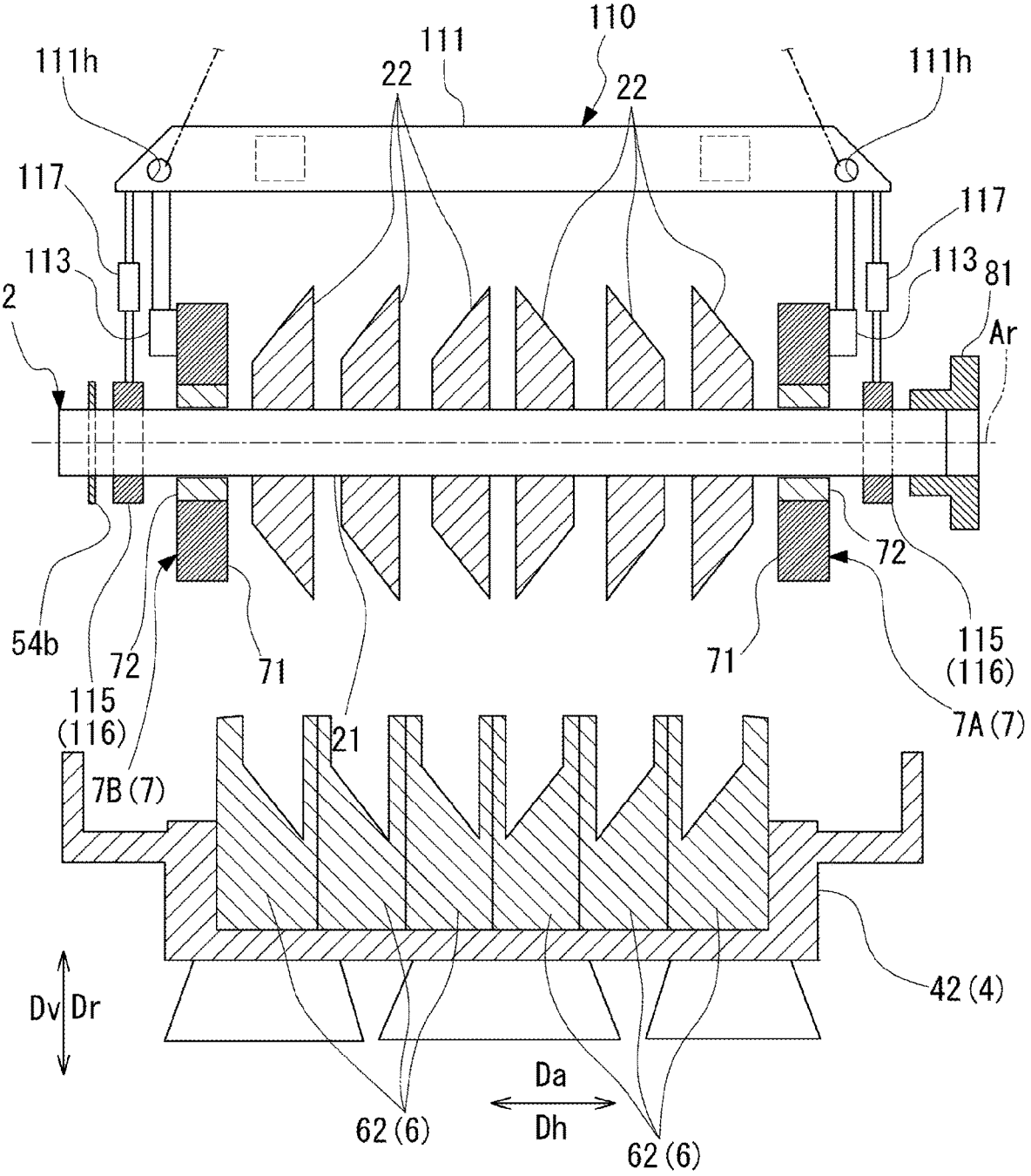
FIG. 7 is a diagram showing a step of removing the rotor from the lower half casing.

In the step S16 of removing the rotor 2 from the lower half casing 42, the beam III is lifted and raised by the lifting machine as shown in FIG. 7. As a result, the rotor 2 hanging from the rotor hanging tool 110 is removed from the lower half casing 42.

Figure 8:
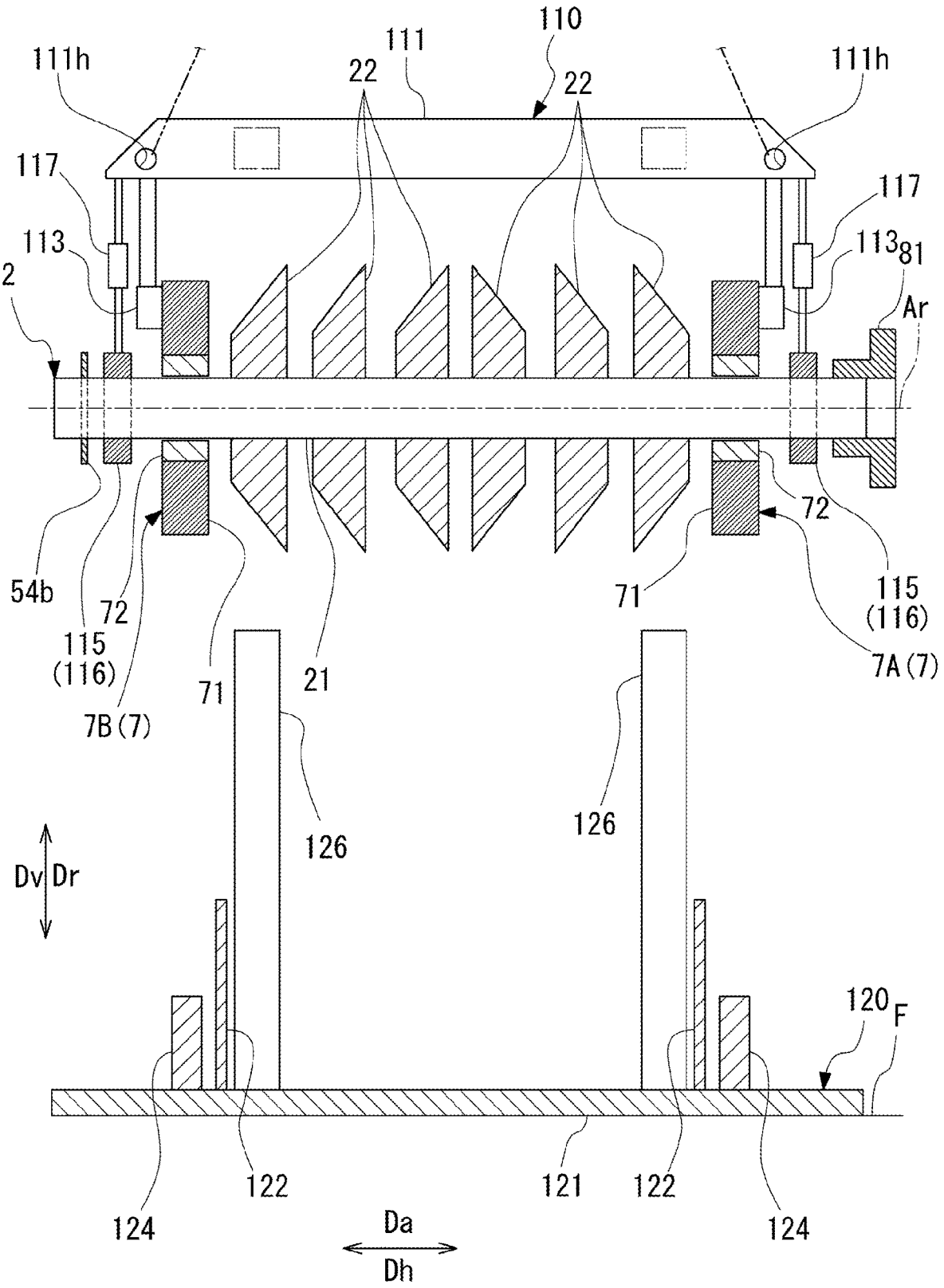
FIG. 8 is a diagram showing a step of moving the rotor above a rotor support base.

As shown in FIG. 8, in the step S17 of moving the rotor 2 above the rotor support base 120, the rotor 2 hanging from the rotor hanging tool 110 is moved by the lifting machine above the rotor support base 120 pre-disposed outside the rotary machine 1.

Figure 9:
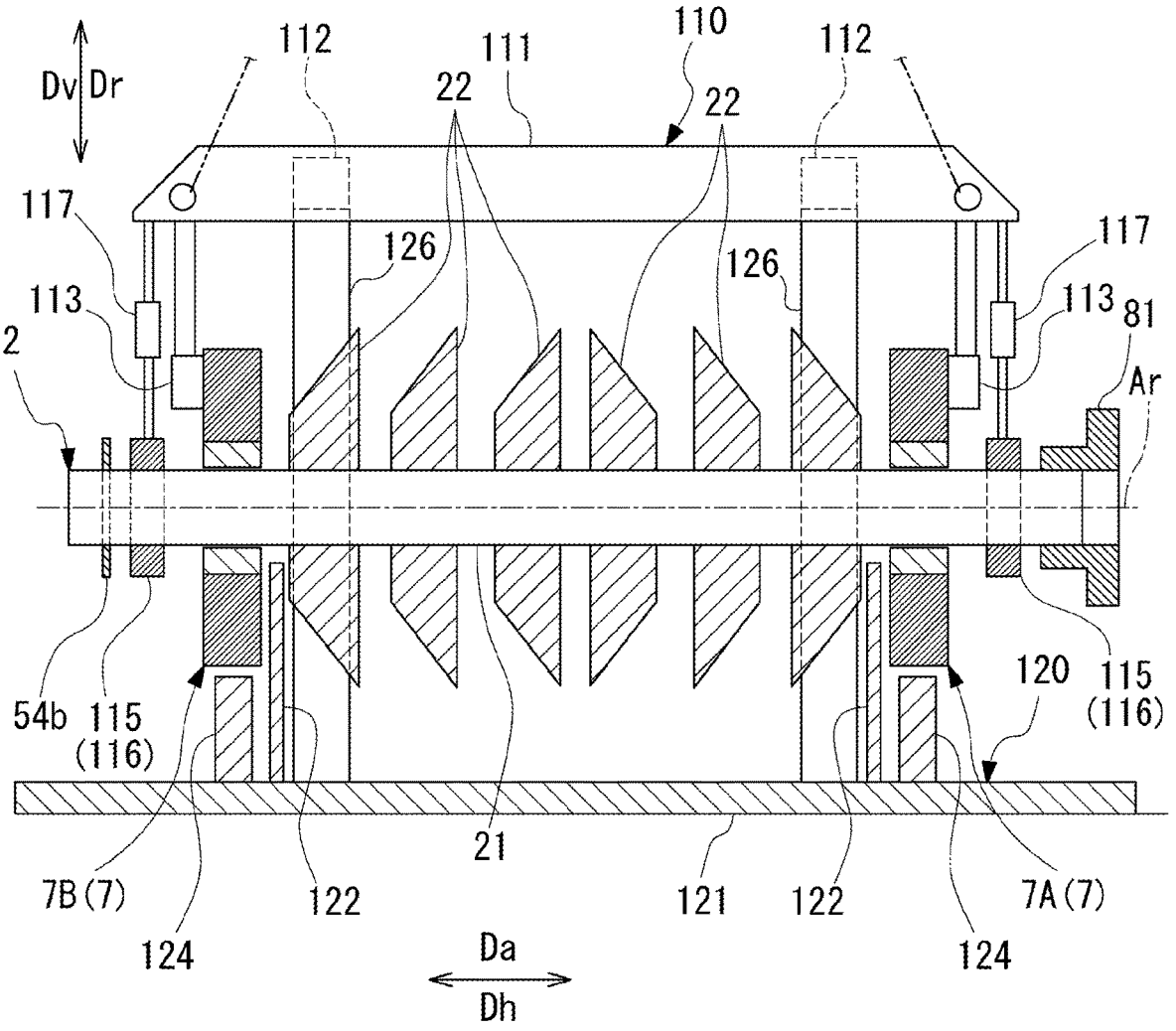
FIG. 9 is a diagram showing a step of supporting the rotor on the rotor support base.

In the step S18 of supporting the rotor 2 on the rotor support base 120, the beam 111 is lowered by the lifting machine as shown in FIG. 9. Then, the rotor hanging tool 110 is lowered such that the distal end portion of each arm 112 is put on the third support portion 126 of the rotor support base 120. Next, the distal end portion of each arm 112 and the upper end of the third support portion 126 are interconnected by a bolt (not shown). As a result, the rotor hanging tool 110 is fixed to the rotor support base 120 in a state where the rotor 2 is hung. In other words, the rotor 2 hanging from the rotor hanging tool 110 is supported in a state where the rotor 2 is incapable of moving relative to the rotor support base 120.

In this state, the rotor support base 120, the rotor 2, and the rotor hanging tool 110 can be mounted on a transport vehicle and transported to a factory or the like different from the place where the rotary machine 1 is installed.

Figure 10:
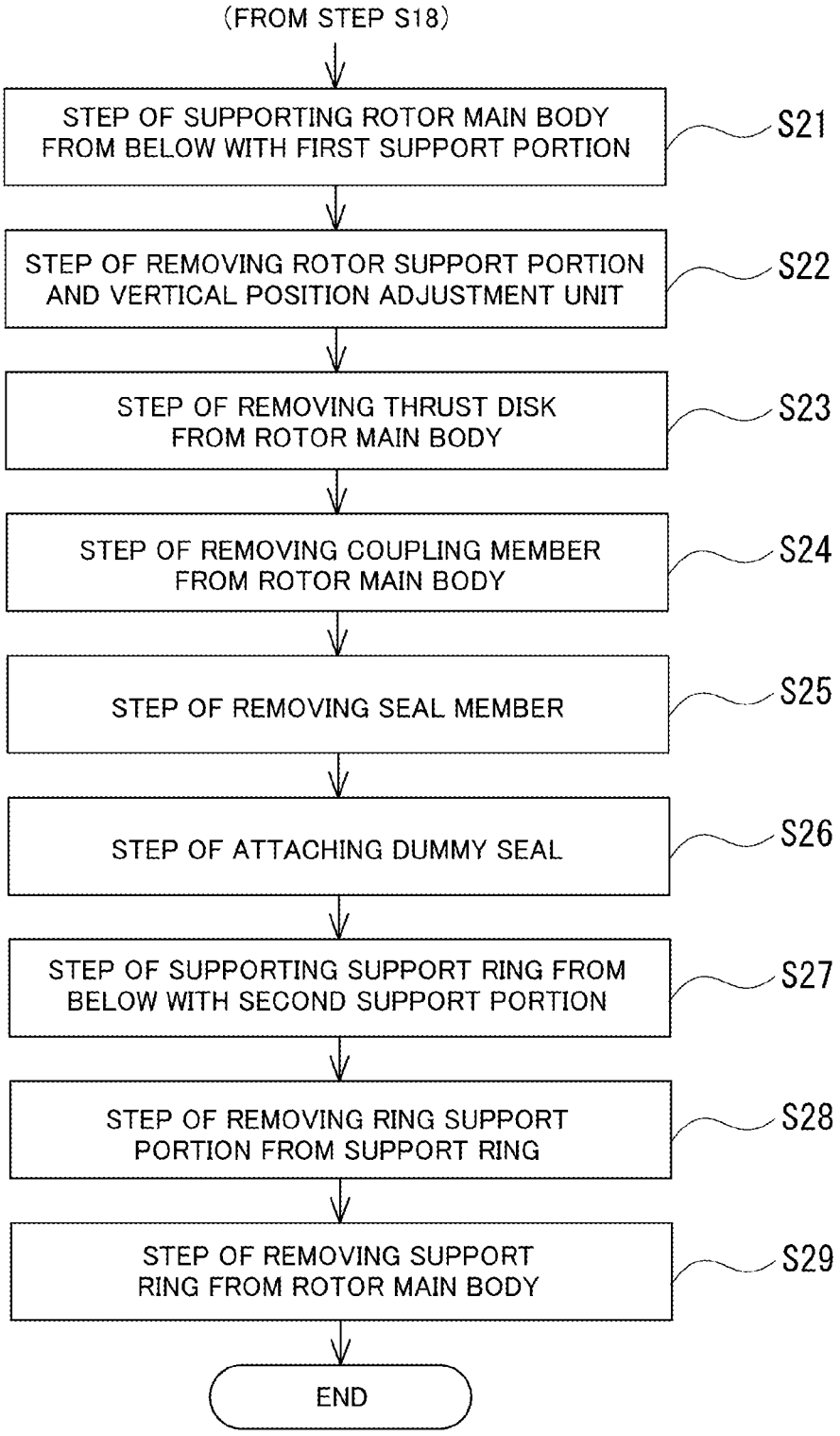
FIG. 10 is a second flowchart showing the procedures of the rotor lifting method and the rotary machine disassembly method according to the embodiment of the present disclosure.

As shown in FIG. 10, the rotary machine disassembly method further includes a step S21 of supporting the rotor main body 21 from below with the first support portion 122, a step S22 of removing the rotor support portion 115 and the vertical position adjustment unit 117, a step S23 of removing the thrust disk 54*b* from the rotor main body 21, a step S24 of removing the coupling member 81 from the rotor main body 21, a step S25 of removing the seal member 72, a step S26 of attaching a dummy seal 90, a step S27 of supporting the support ring 71 from below with the second support portion 124, a step S28 of removing the ring support portion 113 from the support ring 71, and a step S29 of removing the support ring 71 from the rotor main body 21, which are subsequent to the step S18 of supporting the rotor 2 on the rotor support base 120.

Figure 11:
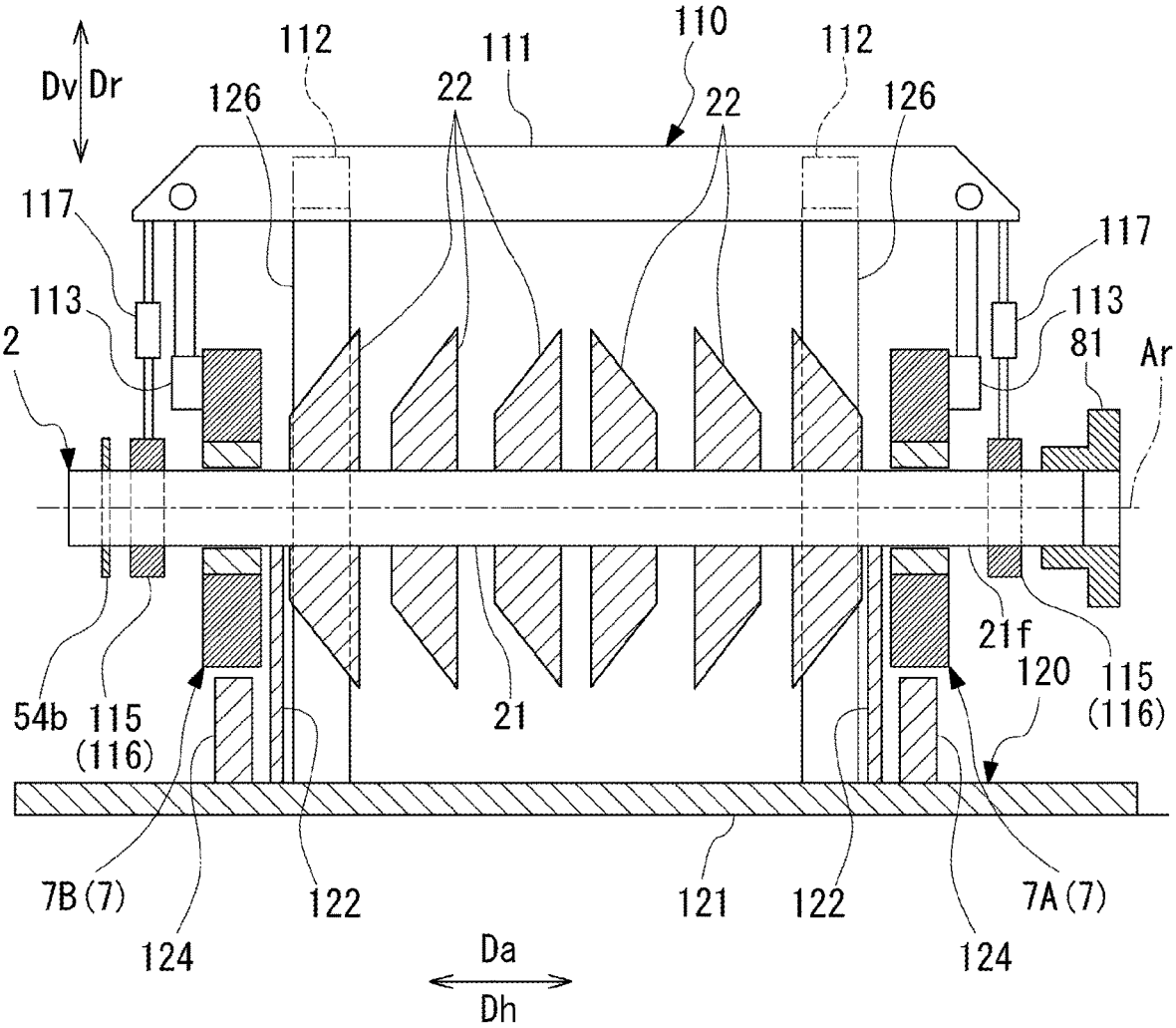
FIG. 11 is a diagram showing a step of supporting the rotor main body from below with a first support portion.

As shown in FIG. 11, in the step S21 of supporting the rotor main body 21 from below with the first support portion 122, the height of the first support portion 122 is adjusted in accordance with the rotor main body 21 hanging from the rotor hanging tool 110 fixed to the rotor support base 120. The rotor main body 21 is supported from below by the first support portion 122 by the rotor support surface of the first support portion 122 being brought into close contact with the lower side of the outer peripheral surface 21*f* of the rotor main body 21. In other words, the rotor main body 21 is supported by the rotor support base 120.

Figure 12:
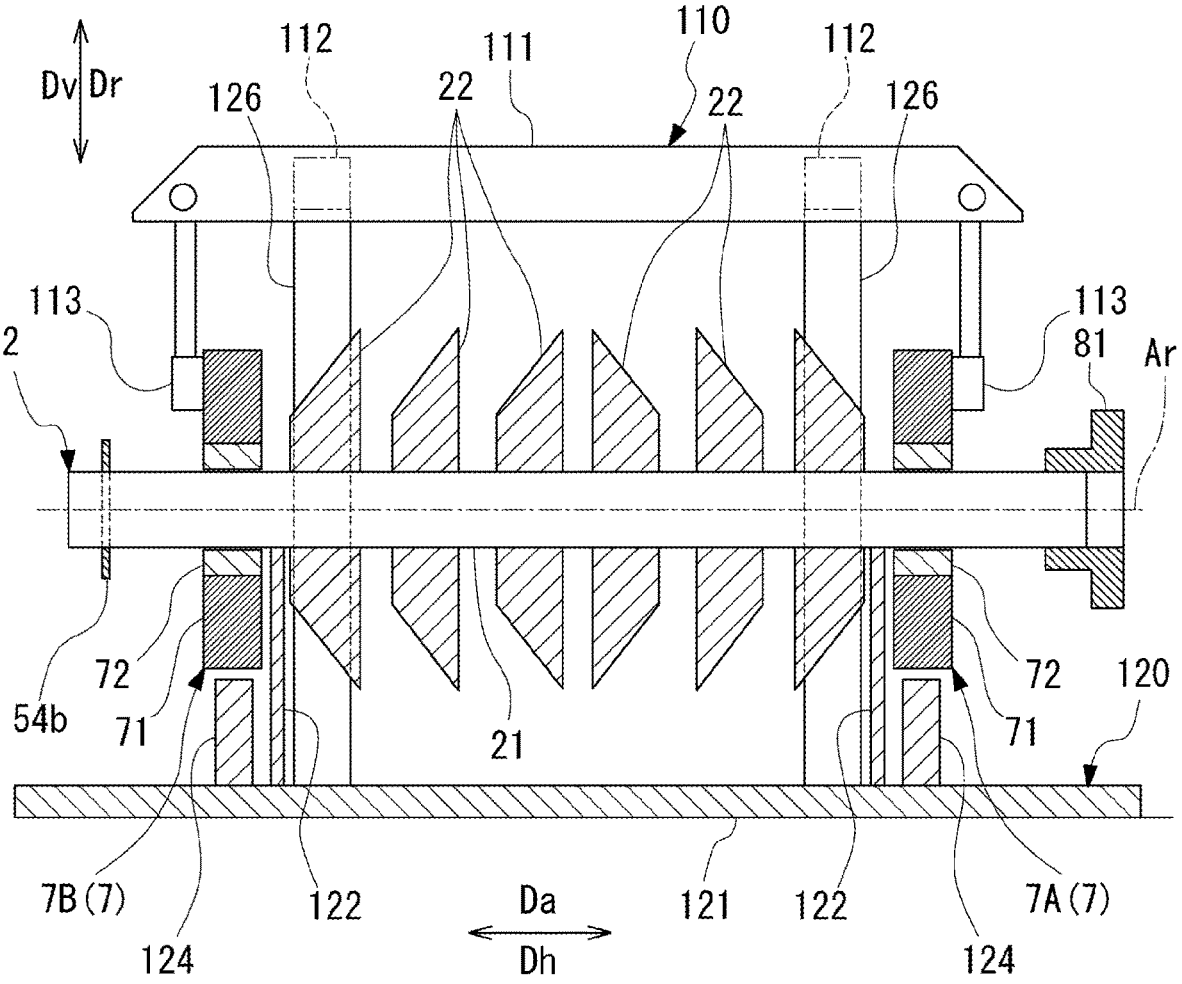
FIG. 12 is a diagram showing a step of removing the rotor support portion and a vertical position adjustment unit.

In the step S22 of removing the rotor support portion 115 and the vertical position adjustment unit 117, the support portion main body 116 is divided into one upper part and one lower part in each of the pair of rotor support portions 115 and removed from the rotor main body 21. Further, the vertical position adjustment unit 117 is removed from the beam 111. As a result, the pair of rotor support portions 115 and the vertical position adjustment unit 117 are removed from the rotor main body 21 and the rotor hanging tool 110 as shown in FIG. 12.

Figure 13:
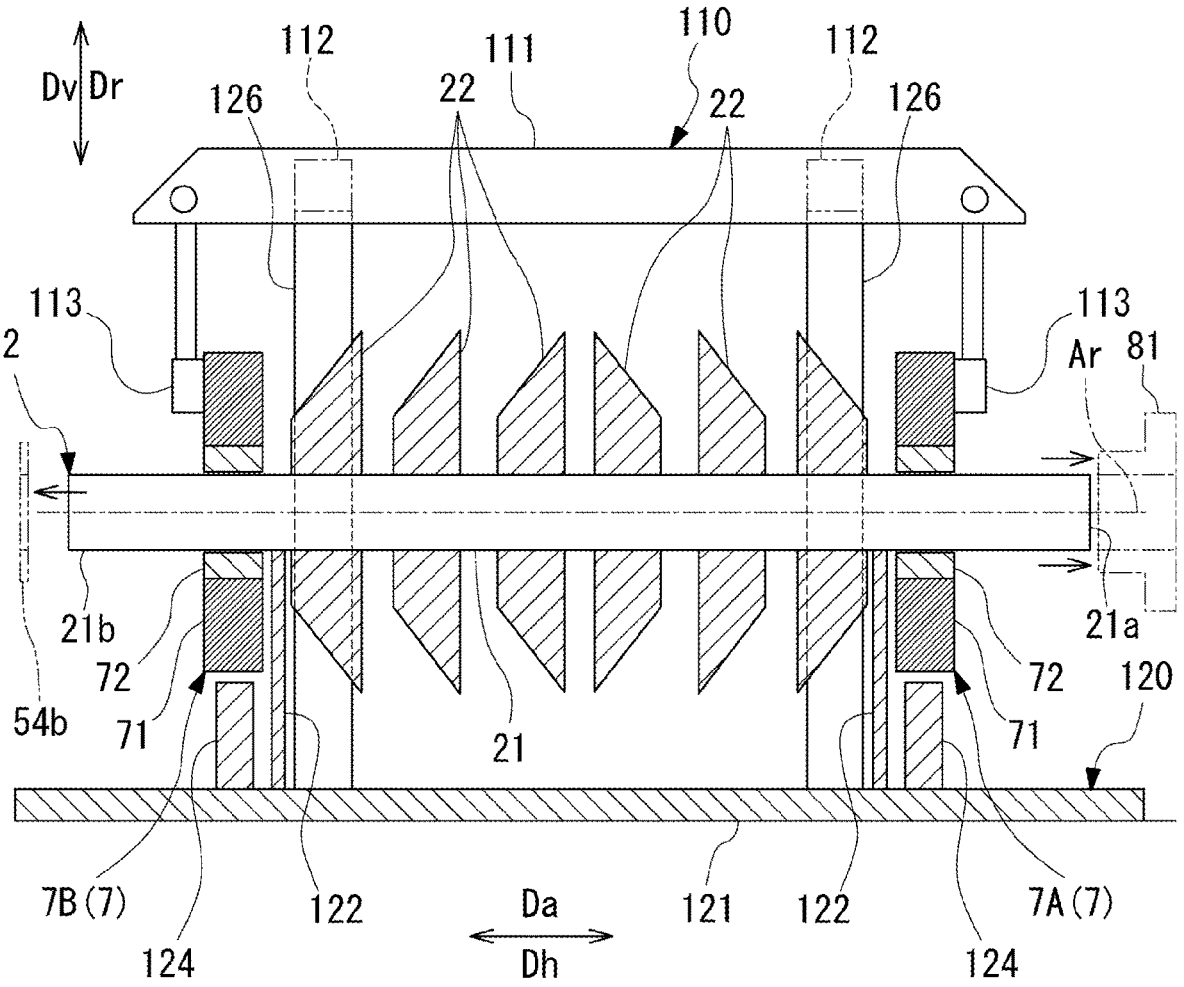
FIG. 13 is a diagram showing a step of removing a thrust disk and a coupling member from the rotor main body.

As shown in FIG. 13, in the step S23 of removing the thrust disk 54*b* from the rotor main body 21, the thrust disk 54*b* is moved in the axial direction Da and removed from the second end 21*b* of the rotor main body 21.

In the step S24 of removing the coupling member 81 from the rotor main body 21, the coupling member 81 provided at the first end 21*a* of the rotor main body 21 is removed from the rotor main body 21.

Figure 14:
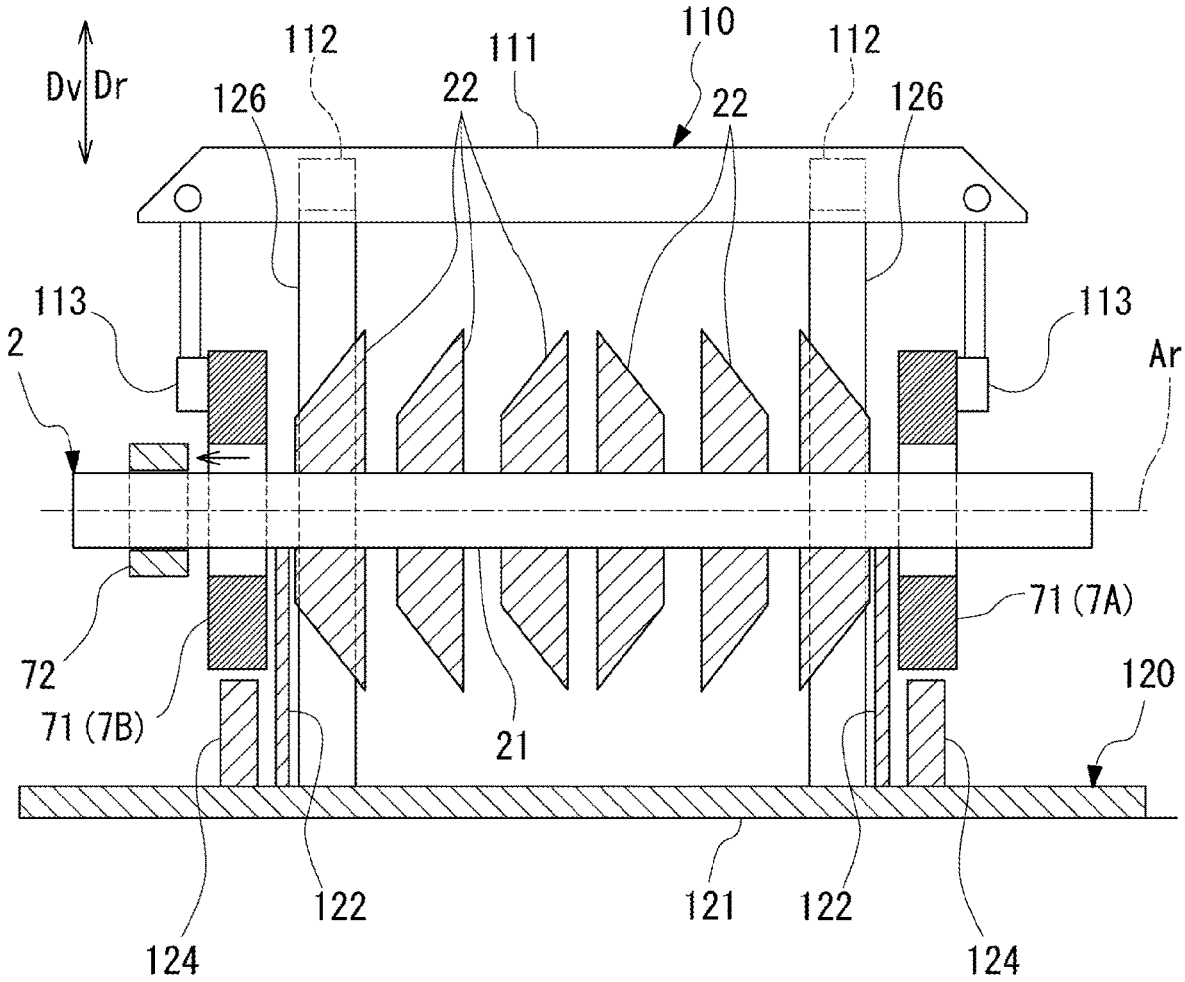
FIG. 14 is a diagram showing a step of removing a seal member.

As shown in FIG. 14, in the step S25 of removing the seal member 72, the seal member 72 is removed from the inner peripheral surface of the support ring 71. The seal member 72 is moved in the axial direction Da and pulled out of the rotor main body 21.

Figure 15:
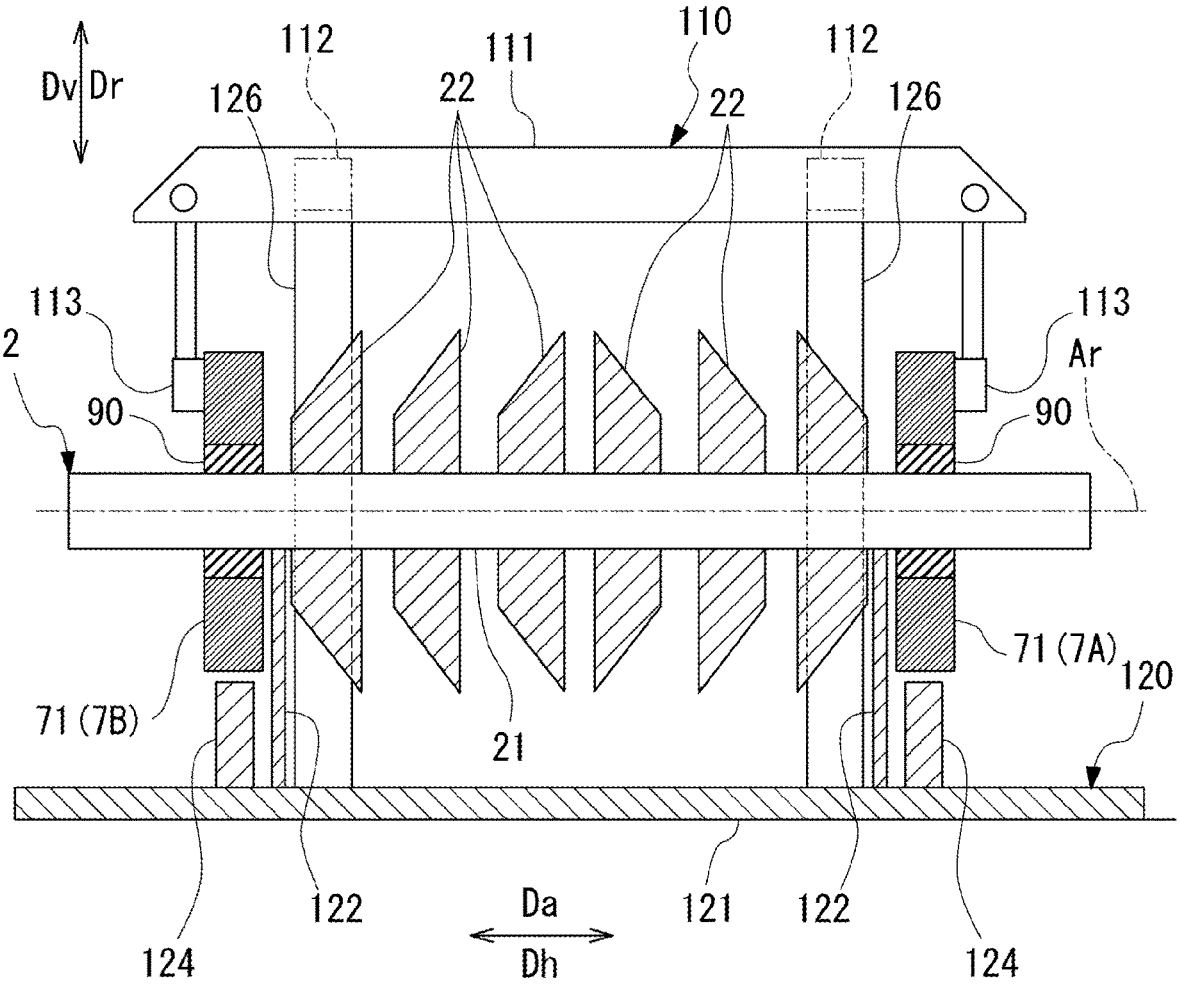
FIG. 15 is a diagram showing a step of attaching a dummy seal.

As shown in FIG. 15, in the step S27 of attaching the dummy seal 90, the dummy seal 90 is attached inside the support ring 71 instead of the seal member 72 removed from the inner side of the support ring 71. The dummy seal 90 has the same size and shape as the seal member 72. The dummy seal 90 is pushed in the axial direction Da along the rotor main body 21. As a result, the dummy seal 90 is inserted inside the support ring 71 in the radial direction Dr.

Figure 16:
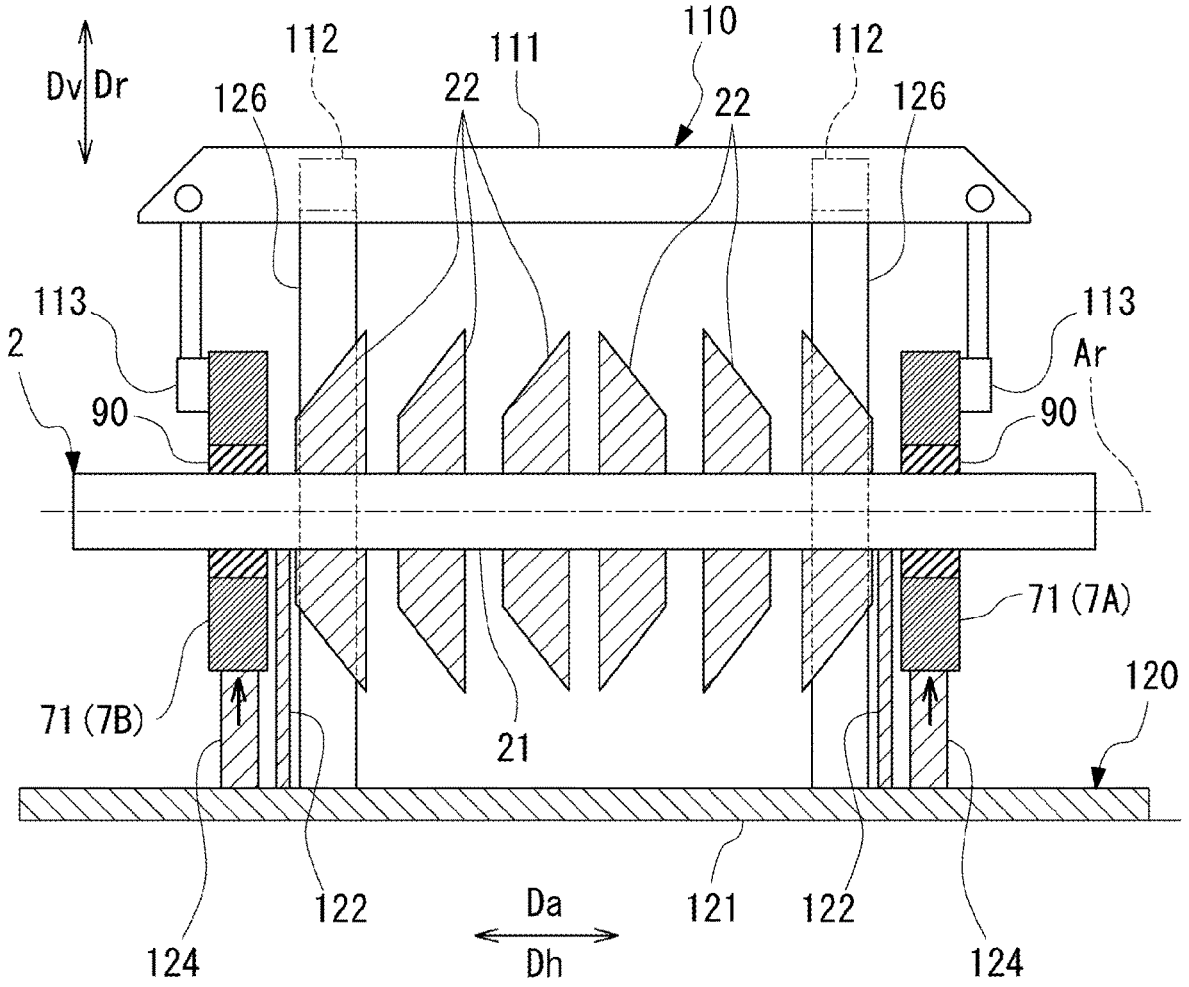
FIG. 16 is a diagram showing a step of supporting the support ring from below with a second support portion.

As shown in FIG. 16, in the step S27 of supporting the support ring 71 from below with the second support portion 124, the height of the second support portion 124 is adjusted in accordance with the support ring 71. The support ring 71 is supported from below by the second support portion 124 by the ring support surface of the second support portion 124 being brought into close contact with the lower side of the support ring 71.

Figure 17:
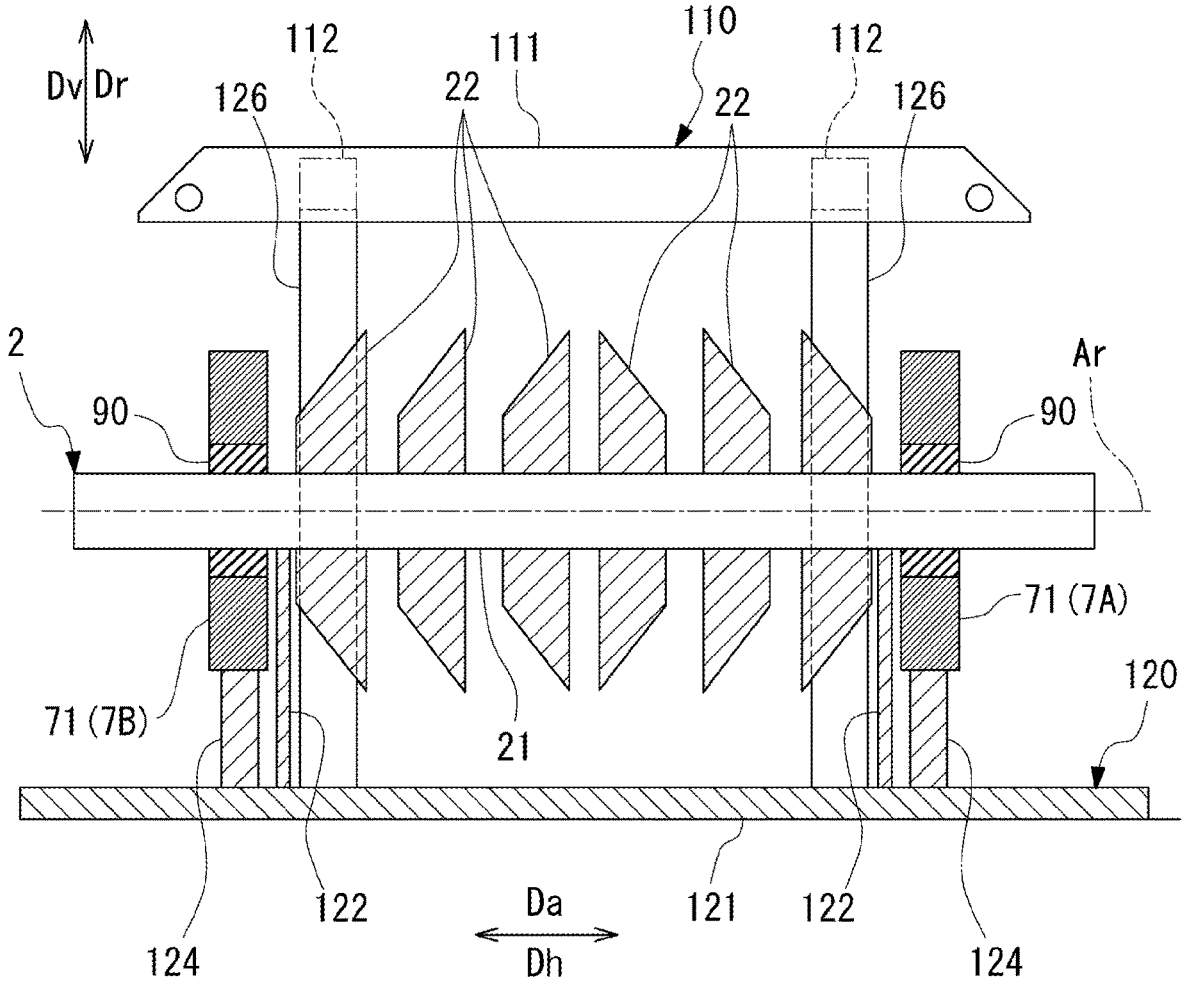
FIG. 17 is a diagram showing a step of removing the ring support portion from the support ring.

In the step S28 of removing the ring support portion 113 from the support ring 71, the bolt (not shown) interconnecting the ring support portion 113 and the support ring 71 is removed. Subsequently, the ring support portion 113 is removed from the beam 111 of the rotor hanging tool 110. As a result, the ring support portion 113 is removed from the support ring 71 as shown in FIG. 17. In this state, the support ring 71 is supported by the second support portion 124 of the rotor support base 120.

Figure 18:
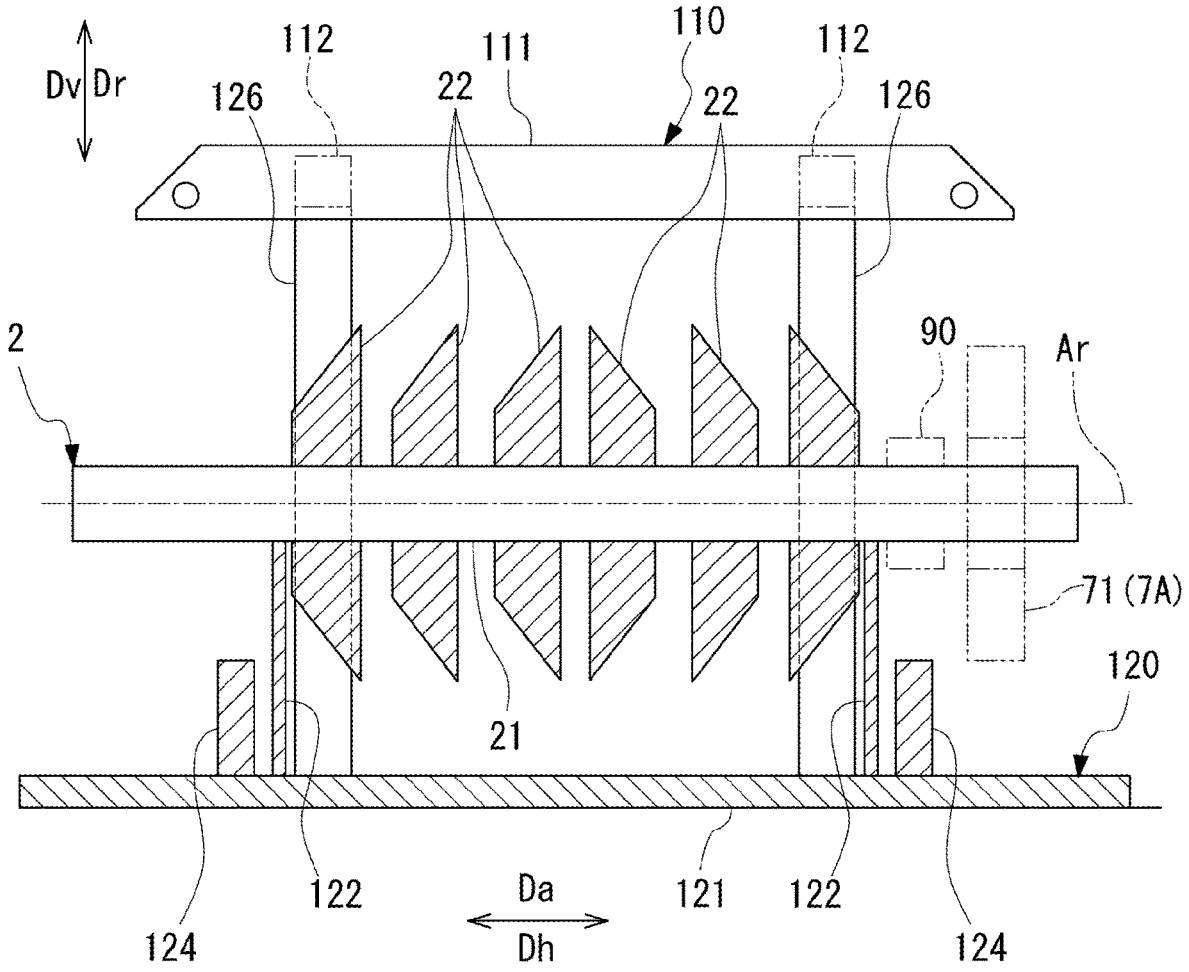
FIG. 18 is a diagram showing a step of removing the support ring from the rotor main body.

As shown in FIG. 18, in the step S29 of removing the support ring 71 from the rotor main body 21, the support ring 71 and the dummy seal 90 are moved along the axial direction Da and removed from the rotor main body 21. At this time, the dummy seal 90 is disposed inside the support ring 71 in the radial direction Dr. Accordingly, direct interference of the support ring 71 with the rotor main body 21 is suppressed.

Figure 19:
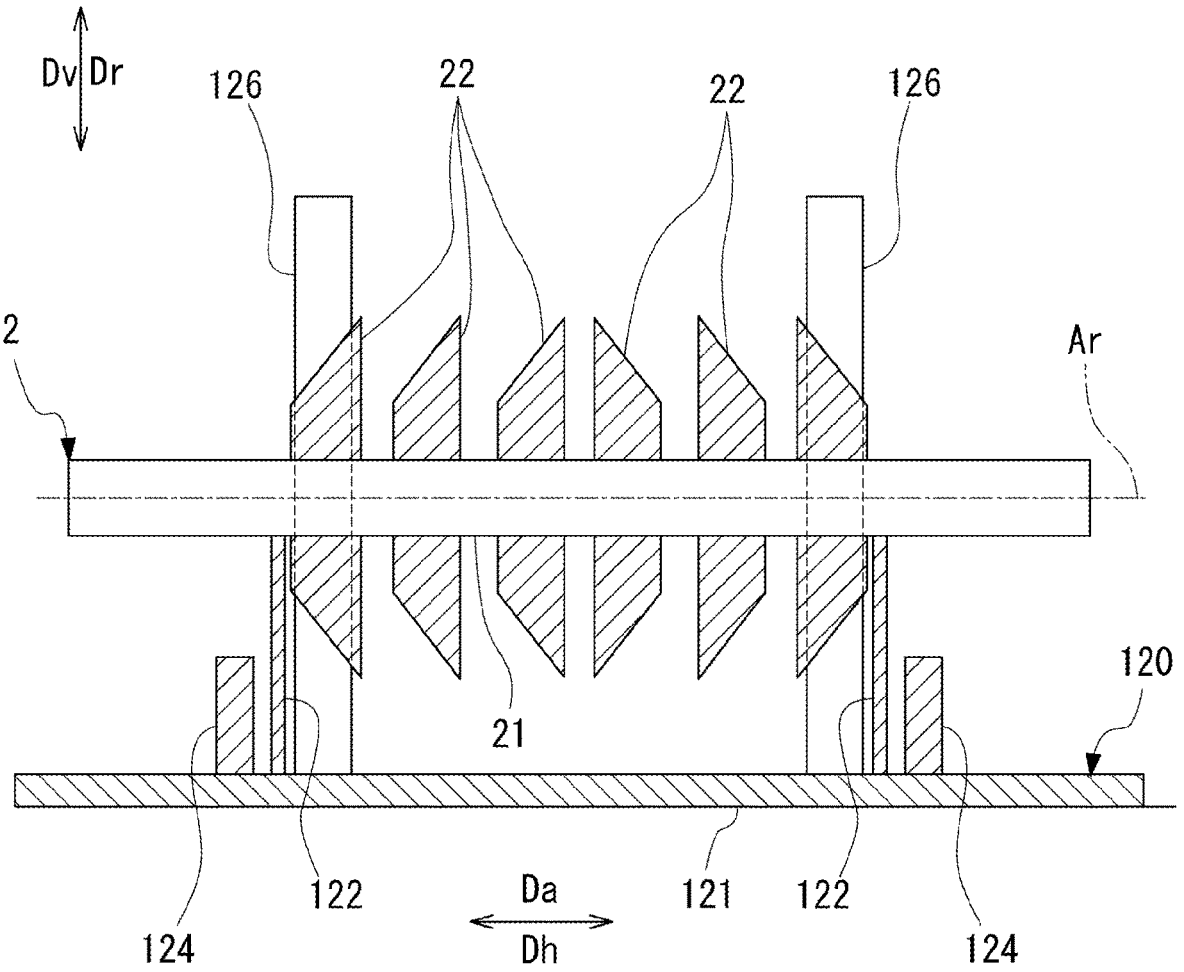
FIG. 19 is a diagram showing a step of removing the rotor hanging tool.

In a step S30 of removing the rotor hanging tool 110, the distal end of each arm 112 and the upper end of the third support portion 126 are disconnected from each other by the bolt (not shown) being removed. Subsequently, the beam 111 is lifted by the lifting machine and removed from the rotor support base 120. As a result, the rotor 2 is supported only by the rotor support base 120 as shown in FIG. 19. Subsequently, necessary maintenance work or the like is performed on each portion of the rotor 2 on the rotor support base 120.

(Procedure of Method for Attaching Rotor to Rotary Machine)

Figure 20:
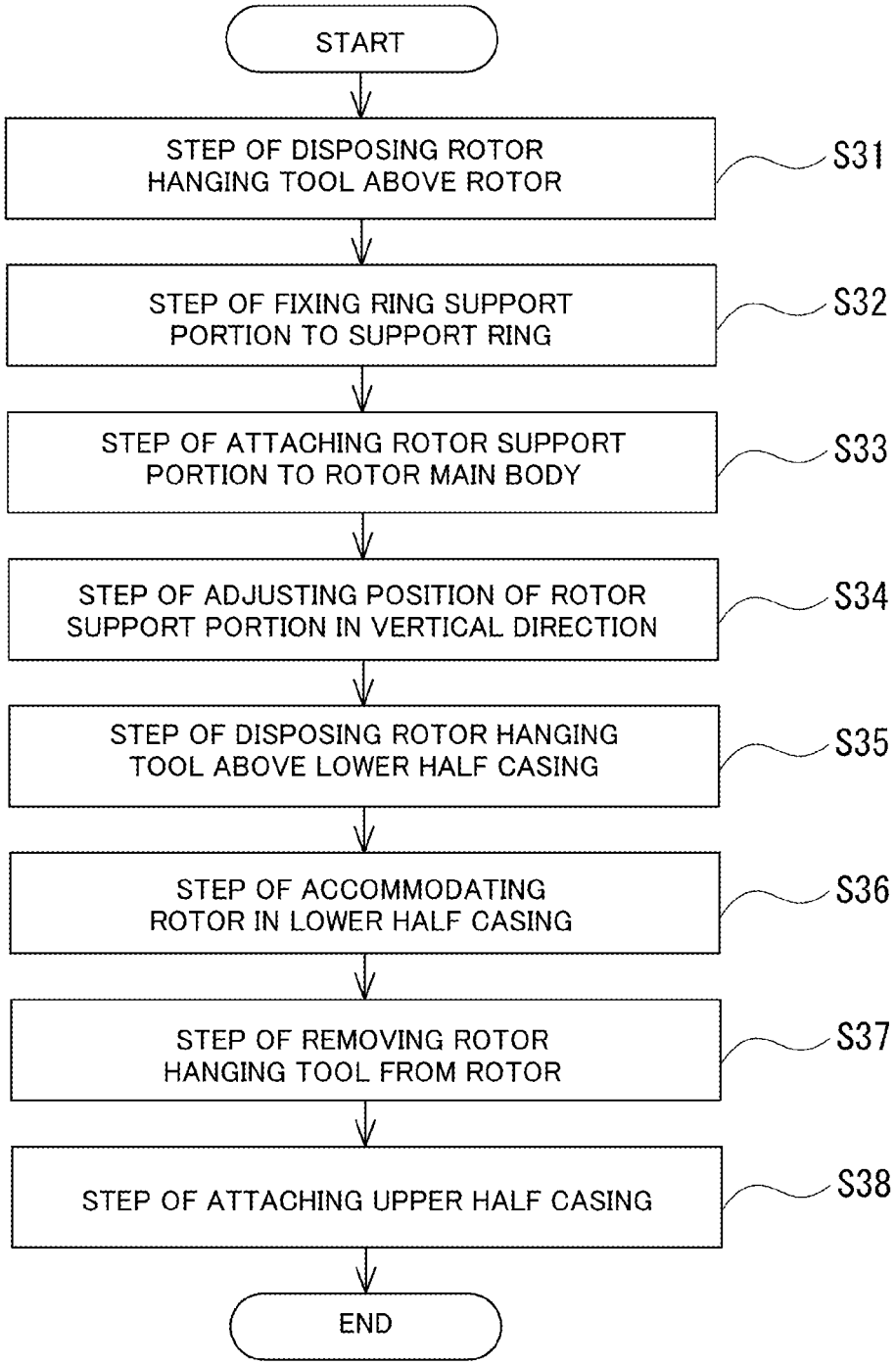
FIG. 20 is a flowchart showing the procedure of a method for attaching a rotor to a rotary machine according to the embodiment of the present disclosure.

Next, the method for attaching the rotor 2 to the rotary machine 1 in assembling the rotary machine 1 will be described. As shown in FIG. 20, the method for attaching the rotor 2 to the rotary machine 1 includes a step S31 of disposing the rotor hanging tool 110 above the rotor 2, a step S32 of fixing the ring support portion 113 to the support ring 71, a step S33 of adjusting the position of the rotor support portion 115 in the vertical direction Dv, a step S34 of supporting the rotor main body 21 with the rotor support portion 115, a step S35 of disposing the rotor hanging tool 110 above the lower half casing 42, a step S36 of accommodating the rotor 2 in the lower half casing 42, a step S37 of removing the rotor hanging tool 110 from the rotor 2, and a step S38 of attaching the upper half casing 41.

Figure 21:
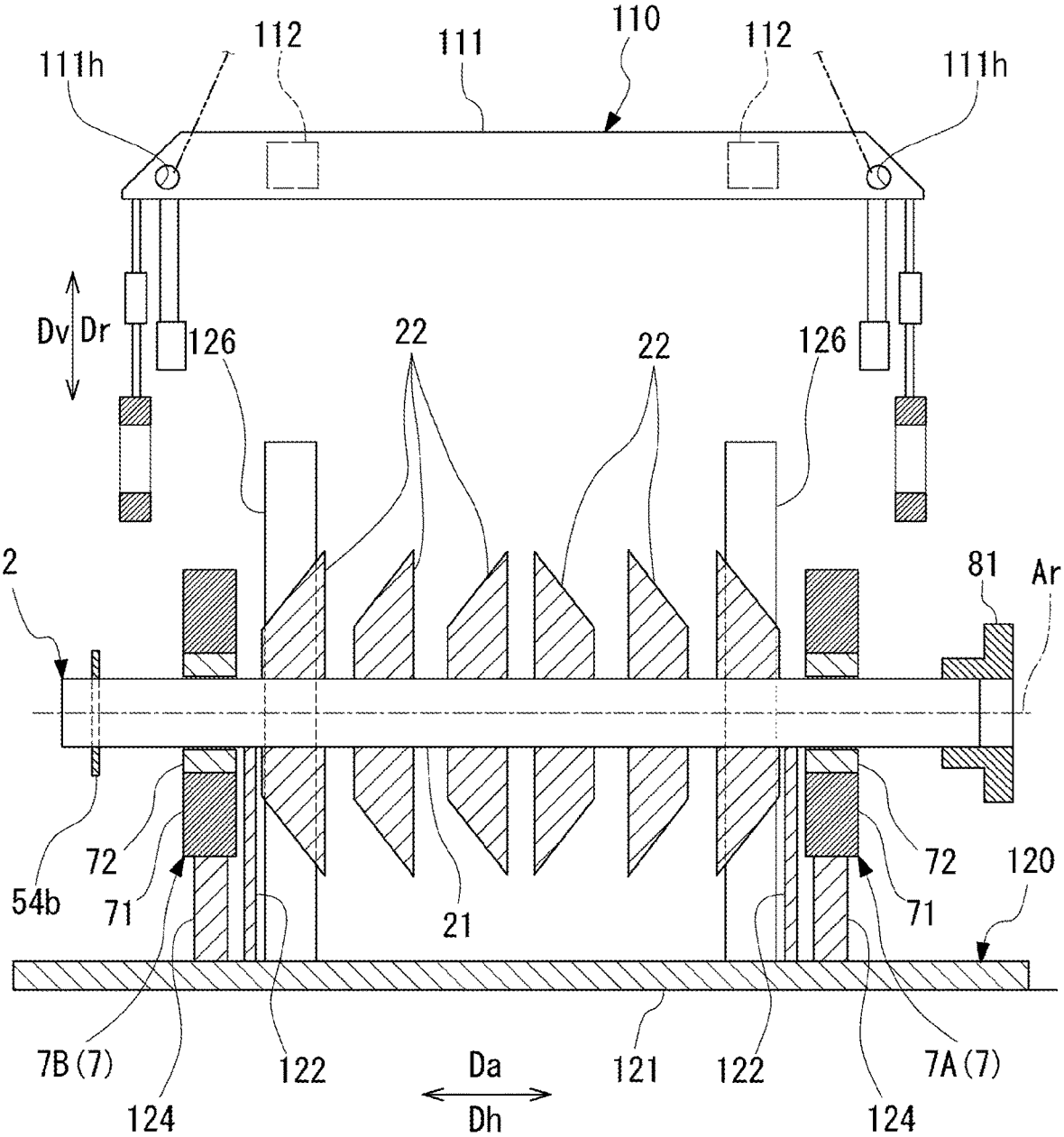
FIG. 21 is a diagram showing a step of disposing the rotor hanging tool above the rotor.

As shown in FIG. 21, in the step S31 of disposing the rotor hanging tool 110 above the rotor 2, the rotor hanging tool 110 is disposed above the rotor 2 attached to the rotary machine 1. Here, the rotor hanging tool 110 is disposed above the rotor 2 on the rotor support base 120 by the beam 111 being lifted by lifting equipment in a case where the rotor 2 is placed on the rotor support base 120. It should be noted that the thrust disk 54*b*, the support ring 71, and the seal member 72 are pre-assembled in the rotor 2.

In the step S32 of fixing the ring support portion 113 to the support ring 71, the lifted beam 111 is first lowered by the lifting machine as shown in FIG. 3. As a result, the rotor hanging tool 110 is disposed such that the pair of ring support portions 113 are along the ring surface 71*f* with respect to the support ring 71. Next, each ring support portion 113 is fixed to the ring surface 71*f* of the support ring 71 by a bolt (not shown).

In the step S33 of attaching the rotor support portion 115 to the rotor main body 21, the rotor main body 21 is sandwiched so as to be surrounded by the support portion main body 116. As a result, the pair of rotor support portions 115 are attached to the rotor main body 21.

In the step S34 of adjusting the position of the rotor support portion 115 in the vertical direction Dv, the vertical position adjustment unit 117 adjusts the positions of the pair of support portion main bodies 116 in the vertical direction Dv in accordance with the rotor main body 21. As a result, the position of the support portion main body 116 in the vertical direction is adjusted such that the position of the center line (axis) of the rotor main body 21 supported by the rotor support portion 115 in the vertical direction Dv is aligned with the position of the center line of the seal member 72 in the vertical direction Dv. As a result, the rotor 2 is supported in a state where the rotor 2 is incapable of moving relative to the rotor hanging tool 110 with the position of the center line of the rotor main body 21 and the position of the center line of the seal member 72 aligned. As a result, the rotor main body 21 is supported from below by the pair of rotor support portions 115 in a core-aligned state.

As shown in FIG. 8, in the step S35 of disposing the rotor hanging tool 110 above the lower half casing 42, the beam 111 is lifted by the lifting machine and the rotor 2 is lifted from the rotor support base 120. As a result, the rotor 2 hanging from the rotor hanging tool 110 is removed from the rotor support base 120. Further, the position of the lifted beam 111 is moved by the lifting machine. As a result, the rotor 2 hanging from the rotor hanging tool 110 is moved above the lower half casing 42 as shown in FIG. 7.

In the step S36 of accommodating the rotor 2 in the lower half casing 42, the rotor hanging tool 110 from which the rotor 2 hangs is lowered by the lifting machine as shown in FIG. 6. As a result, the rotor 2 hanging from the rotor hanging tool 110 is accommodated in the lower half casing 42.

In the step S37 of removing the rotor hanging tool 110 from the rotor 2, the bolt (not shown) is removed as shown in FIG. 5. Subsequently, each ring support portion 113 is separated from the ring surface 71*f* of the support ring 71. Further, the support portion main body 116 is removed from the rotor main body 21 and the rotor support portion 115 is separated from the rotor main body 21. As a result, the rotor hanging tool 110 is separated from the rotor 2. Subsequently, the rotor hanging tool 110 is lifted by the lifting machine and moved from above the rotor 2.

In the step S38 of attaching the upper half casing 41, the first bearing portion 51 and the second bearing portion 52 are assembled to the rotor 2 housed in the lower half casing 42 as shown in FIG. 1. Subsequently, the upper half diaphragm 61 is placed on the lower half diaphragm 62 and the diaphragm 6 is assembled. Further, the upper half casing 41 is placed on the lower half casing 42 and the casing 4 is assembled. As a result, the rotary machine 1 in which the rotor 2 is incorporated is assembled.

(Action and Effect)

In the rotor hanging tool 110 configured as described above, the pair of ring support portions 113 extending downward from the beam 111 support the support ring 71. In addition, the pair of rotor support portions 115 extending downward from the beam 111 support the rotor main body 21. The position of the rotor support portion 115 in the vertical direction Dv with respect to the beam 111 can be adjusted by the vertical position adjustment unit 117. Accordingly, the position of the rotor support portion 115 in the vertical direction Dv can be adjusted in accordance with the rotor main body 21 in a state where the support ring 71 is supported by the ring support portion 113. As a result, the rotor hanging tool 110 is capable of supporting the rotor 2 in a state where the ring support portion 113 and the rotor support portion 115 are core-aligned with the support ring 71 and the rotor main body 21. By using the rotor hanging tool 110, it is possible to lift the rotor 2 with the support ring 71 and the seal member 72 as well as the rotor main body 21 mounted on the rotor main body 21. Accordingly, it is possible to reduce the labor that is required for work such as removal and replacement of the rotor 2, enhance the efficiency of maintenance work, and improve the operating rate of the rotary machine 1.

In addition, since the support ring 71 is continuously supported by the ring support portion 113 of the rotor hanging tool 110, misalignment of the support ring 71 with respect to the rotor main body 21 can be suppressed.

In addition, the ring support portion 113 supporting the support ring 71 is disposed at a position close to the middle portion 21*c* of the rotor main body 21 in the axial direction Da with respect to the rotor support portion 115 supporting the rotor main body 21. As a result, the rotor main body 21 can be supported outside the support ring 71 in the axial direction Da. It is difficult to ensure a space for supporting the rotor main body 21 inside the support ring 71 in the axial direction Da in the rotor main body 21 that is placed on the lower half casing 42 and the lower half diaphragm 62. However, the rotor main body 21 that is placed on the lower half casing 42 and the lower half diaphragm 62 can be easily attached to the rotor hanging tool 110 by the rotor main body 21 being supported outside the support ring 71.

In addition, the first support portion 122 supporting the rotor main body 21 is disposed at a position close to the middle portion 21*c* of the rotor main body 21 in the axial direction Da with respect to the second support portion 124 supporting the support ring 71. As a result, in a case where the support ring 71 supported by the second support portion 124 is moved along the axial direction Da and pulled out of the rotor main body 21, interference of the support ring 71 with the first support portion 122 supporting the rotor main body 21 is avoided. Accordingly, the support ring 71 can be easily removed from the rotor main body 21.

In addition, the rotor hanging tool 110 is supported by the third support portion 126 by the arms 112 extending from the beam 111 to both sides in the width direction Dw. As a result, it is possible to support the rotor hanging tool 110 supporting the rotor 2 with the rotor support base 120 without affecting the rotor 2.

In addition, the rotor support base 120 supports the rotor 2 hanging from the rotor hanging tool 110. The rotor main body 21 is supported from below by the first support portion 122. The support ring 71 is supported from below by the second support portion 124. The rotor hanging tool 110 is supported from below by the third support portion 126. In this manner, the rotor support base 120 is capable of integrally supporting the rotor 2 and the rotor hanging tool 110.

By the method for lifting the rotor 2 using the rotor support jig 100 having the rotor hanging tool 110 and the rotor support base 120, the rotor 2 can be moved by the rotor hanging tool 110 to a place separated from the rotary machine 1 in a state where the central axis positions of the support ring 71 and the rotor main body 21 are aligned. Accordingly, the rotor 2 can be lifted with the support ring 71 and the seal member 72 mounted on the rotor main body 21. In other words, there is no need to remove the seal member 72 from the rotor main body 21 before lifting the rotor 2, and thus there is no need to remove the thrust disk 54*b* and the coupling member 81. As a result, the labor that is required for lifting the rotor 2 can be reduced, the efficiency of maintenance work can be enhanced, and the operating rate of the rotary machine 1 can be improved.

In addition, by the method for disassembling the rotary machine 1 using the method for lifting the rotor 2, the rotor main body 21 removed from the lower half casing 42 of the rotary machine 1 can be hung by the rotor hanging tool 110 or supported by the rotor support base 120. Accordingly, component removal from the rotor main body 21, maintenance work for the rotor 2, and the like can be performed with ease and efficiency. Further, the operating rate of the rotary machine 1 can be improved by the rotary machine 1 incorporating another rotor 2 in place of the removed rotor 2.

In addition, the thrust disk 54*b* is removed from the rotor main body 21 removed from the rotary machine 1 and supported by the rotor support base 120. By removing the vertical position adjustment unit 117 and the rotor support portion 115 of the rotor hanging tool 110 from the rotor main body 21, it is possible to avoid interference with the rotor support portion 115 and the vertical position adjustment unit 117 in removing the thrust disk 54*b*.

Further, the coupling member 81 is also removed from the rotor main body 21 supported by the rotor support base 120. Removal work for the thrust disk 54*b* or the coupling member 81 is performed outside the casing 4. Accordingly, the work can be performed with ease and the efficiency of the work can be enhanced.

In addition, the seal member 72 and the support ring 71 can be removed from the rotor main body 21 supported by the rotor support base 120. When the seal member 72 is removed, the support ring 71 is supported by the second support portion 124. Accordingly, displacement of the support ring 71 with respect to the rotor main body 21 is suppressed. In addition, removal work for the seal member 72 and the support ring 71 is performed outside the casing 4. Accordingly, the work can be performed with ease and the efficiency of the work can be enhanced. Further, the operating rate of the rotary machine 1 can be improved by the rotary machine 1 incorporating another rotor 2 in place of the removed rotor 2.

In addition, the dummy seal 90 is attached instead of the seal member 72 before the support ring 71 is removed from the rotor main body 21, and thus interference of an inner peripheral surface 71*a* of the support ring 71 with the outer peripheral surface 21*f* of the rotor main body 21 is suppressed in a case where the support ring 71 is removed from the rotor main body 21. Accordingly, damage to the support ring 71 or the rotor main body 21 is suppressed.

Modification Example of Embodiment

It should be noted that the present disclosure is not limited to the embodiment in which the rotary machine 1 is exemplified by a centrifugal compressor. The rotary machine 1 may be any machine insofar as the machine is provided with the rotor main body 21, the support ring 71, and the seal member 72.

In addition, in the embodiment described above, the order can be appropriately changed with regard to the procedures of the method for lifting the rotor 2, the method for removing the rotor 2 from the rotary machine 1, and the method for attaching the rotor 2 to the rotary machine 1. Specifically, for example, the order can be appropriately changed with regard to the procedure for removing each portion of the thrust disk 54*b*, the support ring 71, the seal member 72, and the rotor hanging tool 110 from the rotor main body 21 and the procedure for supporting the rotor main body 21 and the support ring 71 with the rotor support base 120.

It should be noted that the rotor 2 can be removed from the rotary machine 1 and the rotor 2 prepared separately from the removed rotor 2 can be attached to the rotary machine 1 by means of the rotor hanging tool 110 in a case where the rotor 2 is removed from the rotary machine 1 by means of the rotor hanging tool 110 described above. As a result, the rotor 2 can be replaced with ease.

In this case, the separately prepared rotor 2 can be attached to the rotary machine 1 after the rotor 2 hanging from the rotor hanging tool 110 is removed from the lower half casing 42 in the step S16 of removing the rotor 2 from the lower half casing 42. In addition, the removed rotor 2 may be temporarily placed on a temporary rotor stand (not shown) after the step S16 of removing the rotor 2 from the lower half casing 42 is completed. It is possible to quickly replace the rotor 2 by subsequently executing the step S35 of disposing the rotor hanging tool 110 above the lower half casing 42 in the rotary machine disassembly method described above.

APPENDIX

In an example, the rotor hanging tool 110, the rotor support jig 100, the rotor support base 120, the method for lifting the rotor 2, and the method for disassembling the rotary machine 1 described in the embodiment are grasped as follows.

(1) The rotor hanging tool 110 according to a first aspect is the rotor hanging tool 110 for hanging the rotor 2 provided with the rotor main body 21 extending in the axial direction Da, the pair of annular support rings 71 respectively disposed at the first end 21*a* and the second end 21*b* of the rotor main body 21 at an interval in the axial direction Da and provided outside the rotor main body 21 in the radial direction Dr, and the pair of seal members 72 disposed on the inner peripheral surface 71*a* of the support ring 71 in a state where a space is open between the seal member 72 and the outer peripheral surface 21*f* of the rotor main body 21. The rotor hanging tool 110 includes the beam 111 extending in parallel to the axial direction Da above the rotor main body 21, the pair of ring support portions 113 disposed at an interval in the axial direction Da, connected to the beam 111, and attachable to and detachable from the support ring 71, the pair of rotor support portions 115 disposed at an interval in the axial direction Da, connected to the beam 111, attachable to and detachable from the rotor main body 21 at positions different from the ring support portion 113 in the axial direction Da, and respectively supporting the rotor main body 21 from below, and the vertical position adjustment unit 117 configured to adjust the position of each of the rotor support portions 115 in a vertical direction Dv with respect to the beam 111.

In addition, examples of the seal member 72 include a dry gas seal and a labyrinth seal. Examples of the vertical position adjustment unit 117 include a turnbuckle.

In the rotor hanging tool 110, the position of the rotor support portion 115 in the vertical direction Dv can be adjusted in accordance with the rotor main body 21 in a state where the support ring 71 is supported by the ring support portion 113. As a result, the rotor hanging tool 110 is capable of supporting the rotor 2 in a state where the ring support portion 113 and the rotor support portion 115 are core-aligned with the support ring 71 and the rotor main body 21. By using the rotor hanging tool 110, it is possible to lift the rotor 2 with the support ring 71 and the seal member 72 as well as the rotor main body 21 mounted on the rotor main body 21. Accordingly, it is possible to reduce the labor that is required for work such as removal and replacement of the rotor 2, enhance the efficiency of maintenance work, and improve the operating rate of the rotary machine 1.

(2) The rotor hanging tool 110 according to a second aspect is the rotor hanging tool 110 according to (1), and may further include the arms 112 disposed at locations at intervals in the axial direction Da and extending from the beam 111 to both sides in the width direction Dw orthogonal to the axial direction Da.

As a result, it is possible to support the rotor hanging tool 110 supporting the rotor 2 with the rotor support base 120 without affecting the rotor 2.

(3) The rotor hanging tool 110 according to a third aspect is the rotor hanging tool 110 according to (1) or (2), the pair of ring support portions 113 may be disposed at positions respectively close to the middle portion of the rotor main body 21 in the axial direction Da with respect to the pair of rotor support portions 115.

As a result, the rotor main body 21 can be supported outside the support ring 71 in the axial direction Da. It is difficult to ensure a space for supporting the rotor main body 21 inside the support ring 71 in the axial direction Da in the rotor main body 21 that is placed on the lower half casing 42 and the lower half diaphragm 62. However, the rotor main body 21 that is placed on the lower half casing 42 and the lower half diaphragm 62 can be easily attached to the rotor hanging tool 110 by the rotor main body 21 being supported outside the support ring 71.

(4) The rotor support jig 100 according to a fourth aspect includes the rotor hanging tool 110 according to any one of (1) to (3) and the rotor support base 120 configured to support the rotor 2 hanging from the rotor hanging tool 110 from below the rotor 2. The rotor support base 120 includes the pair of first support portions 122 configured to support the rotor main body 21 from below, the heights of the pair of first support portions 122 in the vertical direction being adjustable, and the pair of second support portions 124 configured to support the support ring 71 from below, the heights of the pair of second support portions 124 in the vertical direction being adjustable.

As a result, the rotor support base 120 supports the rotor 2 hanging from the rotor hanging tool 110. The rotor main body 21 is supported from below by the first support portion 122. The support ring 71 is supported from below by the second support portion 124. In this manner, the rotor support base 120 supports the rotor 2 with the rotor main body 21 and the support ring 71. The rotor support base 120 is capable of supporting the rotor 2 in a state where the rotor main body 21 and the support ring 71 are core-aligned by adjusting the heights of the first support portion 122 and the second support portion 124 in the vertical direction Dv.

(5) The rotor support jig 100 according to a fifth aspect is the rotor support jig 100 according to (4). The rotor support base 120 may further include the third support portion 126 disposed at a position separated from the rotor 2 in the width direction Dw orthogonal to the axial direction Da and supporting the rotor hanging tool 110 from below.

As a result, the rotor support base 120 is capable of supporting the rotor 2 hanging from the rotor hanging tool 110 in a state where the third support portion 126 supports the rotor hanging tool 110 from below. In this manner, the rotor support base 120 is capable of integrally supporting the rotor 2 and the rotor hanging tool 110.

(6) The method for lifting the rotor 2 according to a sixth aspect is a method for lifting the rotor 2 using the rotor hanging tool 110 according to any one of (1) to (3). The method includes disposing the rotor hanging tool 110 above the rotor 2, respectively fixing the pair of ring support portions 113 to the pair of support rings 71 after disposing the rotor hanging tool 110 above the rotor 2, supporting the rotor main body 21 from below with the pair of rotor support portions 115 after fixing the ring support portion 113 and the support ring 71 to each other, adjusting a vertical direction position of the rotor support portion 115 with the vertical position adjustment unit 117 such that a vertical direction position of the center line of the rotor main body 21 supported by the rotor support portion 115 is aligned with a vertical direction position of the center line of the seal member 72, and lifting the rotor hanging tool 110 upward with the position of the rotor support portion 115 in the vertical direction Dv adjusted.

As a result, by means of the rotor hanging tool 110, the rotor 2 can be moved to a place separated from the rotary machine 1 in a state where the central axis positions of the support ring 71 of the rotor 2 and the rotor main body 21 are aligned and the ring support portion 113 and the rotor support portion 115 are aligned. Accordingly, the rotor 2 can be lifted by the rotor hanging tool 110 with the support ring 71 and the seal member 72 mounted on the rotor main body 21. In other words, there is no need to remove the seal member 72 from the rotor main body 21 before lifting the rotor 2. As a result, it is possible to reduce the labor that is required for work such as removal and replacement of the rotor 2, enhance the efficiency of maintenance work, and improve the operating rate of the rotary machine 1.

(7) The method for disassembling the rotary machine 1 according to a seventh aspect is a rotary machine 1 disassembly method for disassembling the rotary machine 1 including the casing 4 provided with the lower half casing 42 and the upper half casing 41 provided above the lower half casing 42 and the rotor 2 provided in the casing 4 so as to be rotatable around the axis Ar by using the rotor hanging tool according to any one of (1) to (3). The method includes removing the upper half casing 41 and exposing the upper half of the rotor 2 on the lower half casing 42, disposing the rotor hanging tool 110 above the rotor 2 of which the upper half is exposed, respectively fixing the pair of ring support portions 113 to the pair of support rings 71 after disposing the rotor hanging tool 110 above the rotor 2, supporting the rotor main body 21 from below with the pair of rotor support portions 115 after fixing the ring support portion 113 and the support ring 71 to each other, adjusting the position of the rotor support portion 115 in the vertical direction Dv with the vertical position adjustment unit 117 such that the vertical direction position of the center line of the rotor main body 21 supported by the rotor support portion 115 is aligned with the vertical direction position of the center line of the seal member 72, and lifting the rotor hanging tool 110 upward with the position of the rotor support portion 115 in the vertical direction Dv adjusted and removing the rotor 2 from the lower half casing 42.

As a result, there is no need to remove the seal member 72 from the rotor main body 21 before lifting the rotor 2. As a result, it is possible to reduce the labor that is required for work such as removal and replacement of the rotor 2, enhance the efficiency of maintenance work, and improve the operating rate of the rotary machine 1.

REFERENCE SIGNS LIST

1: Rotary machine
2: Rotor

4: Casing
5: Bearing portion
7: Seal portion
7A: First seal portion
7B: Second seal portion
21: Rotor main body
21*a*: First end
21*b*: Second end
21*c*: Middle portion
21*f*: Outer peripheral surface
22: Impeller
41: Upper half casing
42: Lower half casing
47: Suction port
48: Discharge port
51: First bearing portion
52: Second bearing portion
53A, 53B: Journal bearing
54: Thrust bearing
54*a*: Bearing pad
54*b*: Thrust disk
71: Support ring
71*a*: Inner peripheral surface
71*f*: Ring surface
72: Seal member
81: Coupling member
90: Dummy seal
100: Rotor support jig
110: Rotor hanging tool
111: Beam
111*h*: Attachment hole
112: Arm
113: Ring support portion
115: Rotor support portion
116: Support portion main body
117: Vertical position adjustment unit
120: Rotor support base
121: Base
122: First support portion
124: Second support portion
126: Third support portion
200: External shaft
Ar: Axis
Da: Axial direction
Dc: Circumferential direction
Dh: Horizontal direction
Dp: Longitudinal direction
Dq: Short direction
Dr: Radial direction
Dv: Vertical direction
Dw: Width direction
F: Installation surface

What is claimed is:

1. A rotor hanging tool for hanging a rotor provided with a rotor main body extending in an axial direction, a pair of annular support rings respectively disposed at a first end and a second end of the rotor main body at an interval in the axial direction and provided outside the rotor main body in a radial direction, and a pair of seal members disposed on an inner peripheral surface of the support ring in a state where a space is open between the seal member and an outer peripheral surface of the rotor main body, the rotor hanging tool comprising:

a beam extending in parallel to the axial direction above the rotor main body;

a pair of ring support portions disposed at an interval in the axial direction, connected to the beam, and attachable to and detachable from the support ring;

a pair of rotor support portions disposed at an interval in the axial direction, connected to the beam, attachable to and detachable from the rotor main body at positions different from the ring support portions in the axial direction, and respectively supporting the rotor main body from below; and a vertical position adjustment unit configured to adjust a position of each of the rotor support portions in a vertical direction with respect to the beam.

2. The rotor hanging tool according to claim 1, further comprising arms disposed at locations at intervals in the axial direction and extending from the beam to both sides in a width direction orthogonal to the axial direction.

3. The rotor hanging tool according to claim 1, wherein the pair of ring support portions are disposed at positions respectively close to a middle portion of the rotor main body in the axial direction with respect to the pair of rotor support portions.

4. A rotor support jig comprising:

the rotor hanging tool according to claim 1; and a rotor support base configured to support the rotor hung by the rotor hanging tool from below the rotor, wherein the rotor support base comprises:

a first pair of support portions configured to support the rotor main body from below; and a second pair of support portions configured to support the support ring from below, and at least one pair of the first pair and the second pair is adjustable in height in a vertical direction thereof.

5. The rotor support jig according to claim 4, wherein the rotor support base further includes a third support portion disposed at a position separated from the rotor in a width direction orthogonal to the axial direction and supporting the rotor hanging tool from below.

* * * * *